US010214011B2

(12) United States Patent
Muto

(10) Patent No.: US 10,214,011 B2
(45) Date of Patent: Feb. 26, 2019

(54) LIQUID JETTING APPARATUS AND METHOD FOR SELECTING OVERLAPPING NOZZLE

(71) Applicant: BROTHER KOGYO KABUSHIKI KAISHA, Nagoya-shi, Aichi-ken (JP)

(72) Inventor: Masato Muto, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/469,970

(22) Filed: Mar. 27, 2017

(65) Prior Publication Data

US 2017/0282545 A1 Oct. 5, 2017

(30) Foreign Application Priority Data

Mar. 31, 2016 (JP) ..... 2016-073019

(51) Int. Cl.
*B41J 2/045* (2006.01)

(52) U.S. Cl.
CPC ..... *B41J 2/04568* (2013.01); *B41J 2/0452* (2013.01); *B41J 2/04541* (2013.01); *B41J 2/04576* (2013.01); *B41J 2/04581* (2013.01); *B41J 2/04586* (2013.01)

(58) Field of Classification Search
CPC .. B41J 2/0452; B41J 2/04541; B41J 2/04568; B41J 2/04576; B41J 2/04581
See application file for complete search history.

(56) References Cited

U.S. PATENT DOCUMENTS

2006/0284910 A1 12/2006 Aruga
2007/0076026 A1* 4/2007 Nakayama ..... B41J 2/04541 347/9
2015/0273907 A1* 10/2015 Takino ..... B41J 2/14 347/39
2015/0298454 A1* 10/2015 Fukazawa ..... B41J 2/0451 347/19

FOREIGN PATENT DOCUMENTS

JP 2007-030503 A 2/2007
JP 2010-000680 A 1/2010

* cited by examiner

*Primary Examiner* — Kristal Feggins
*Assistant Examiner* — Kendrick Liu
(74) *Attorney, Agent, or Firm* — Scully, Scott, Murphy & Presser, P.C.

(57) ABSTRACT

A liquid jetting apparatus includes: a first head chip having first nozzles arranged in a nozzle arrangement direction; a second head chip having second nozzles arranged in the nozzle arrangement direction, and being arranged to overlap at least partially with the first head chip in an orthogonal direction orthogonal to the nozzle arrangement direction; a controller configured to control the first head chip and the second head chip to jet liquid from the first nozzles and the second nozzles; and power sources having different voltages, respectively. Each of the first nozzles and the second nozzles is driven by voltage supplied from one of the power sources, and the first head chip has a first overlapping portion and the second head chip has a second overlapping portion overlapping with the first overlapping portion in the orthogonal direction.

20 Claims, 20 Drawing Sheets

Fig. 9

| HEAD CHIP 11B | | |
|---|---|---|
| DRIVE VOLTAGE | OVERLAPPING PORTION | NON-OVERLAPPING PORTION |
| 31V | 5 | 50 |
| 29V | - | 200 |
| 28V | 15 | 250 |
| 26V | 10 | 100 |
| 25V | - | 250 |
| 24V | - | 50 |

| HEAD CHIP 11C | | |
|---|---|---|
| DRIVE VOLTAGE | OVERLAPPING PORTION | NON-OVERLAPPING PORTION |
| 30V | - | 50 |
| 28V | 20 | 200 |
| 27V | - | 150 |
| 26V | 10 | 350 |
| 25V | - | 100 |
| 23V | - | 100 |

Fig. 10

| HEAD CHIP 11B | | |
|---|---|---|
| DRIVE VOLTAGE | OVERLAPPING PORTION | NON-OVERLAPPING PORTION |
| 31V | 5 | 50 |
| 29V | - | 50 |
| 28V | 15 | 400 |
| 26V | 10 | 100 |
| 25V | - | 50 |
| 24V | - | 50 |

| HEAD CHIP 11C | | |
|---|---|---|
| DRIVE VOLTAGE | OVERLAPPING PORTION | NON-OVERLAPPING PORTION |
| 30V | - | 50 |
| 28V | 20 | 200 |
| 27V | - | 100 |
| 26V | 10 | 350 |
| 25V | - | 150 |
| 23V | - | 100 |

LIQUID JETTING APPARATUS AND METHOD FOR SELECTING OVERLAPPING NOZZLE

CROSS REFERENCE TO RELATED APPLICATION

The present application claims priority from Japanese Patent Application No. 2016-073019, filed on Mar. 31, 2016, the disclosure of which is incorporated herein by reference in its entirety.

BACKGROUND

Field of the Invention

The present invention relates to a liquid jetting apparatus and a method for selecting an overlapping nozzle to jet liquid.

Description of the Related Art

Conventionally, such a printer is proposed as to have a plurality of so-called line heads. Each of the line heads is formed with a plurality of head chip rows. Each head chip row includes head chips arranged in one direction. Each head chip is formed with a plurality of nozzles to jet liquid (such as ink, for example).

On the other hand, such an image forming apparatus is known as including a long recording head constructed by arranging short recording heads such that the short recording heads partially overlap with each other. Such an image formation apparatus controls driving of nozzles according to the phase difference due to the positions of the nozzles of the overlapping short recording heads and controls the driving of the nozzles according to the recording density property of each of the nozzle rows. By virtue of this, correction is made for the density of an image formed by the overlapping part of the short recording heads.

As described above, with a line head formed with a plurality of head chip rows, the individual head chips constituting one row are arranged to overlap at least partially with the individual head chips constituting another row, in a direction intersecting the one direction.

In such overlapping portions, when the liquid is jetted, frequency of using the nozzles is liable to be biased to one overlapping portion. Therefore, heat value and power consumption of the power source for driving the line head may increase.

SUMMARY

According to an aspect of the present teaching, there is provided a liquid jetting apparatus including: a first head chip having first nozzles arranged in a nozzle arrangement direction; a second head chip having second nozzles arranged in the nozzle arrangement direction, and being arranged to overlap at least partially with the first head chip in an orthogonal direction orthogonal to the nozzle arrangement direction; a controller configured to control the first head chip and the second head chip to jet liquid from the first nozzles and the second nozzles; and power sources having different voltages, respectively, wherein each of the first nozzles and the second nozzles is driven by voltage supplied from one of the power sources, the first head chip has a first overlapping portion and the second head chip has a second overlapping portion, the first overlapping portion and the second overlapping portion overlapping in the orthogonal direction with each other, and the controller is configured to: acquire information of drive voltages for first execution nozzles, which are included in the first nozzles and from which the liquid is to be jetted: acquire information of drive voltages for second execution nozzles, which are included in the second nozzles and from which the liquid is to be jetted; and based on the information of the drive voltages for the first execution nozzles and the second execution nozzles, select one of a first overlapping nozzle and a second overlapping nozzle overlapping in the orthogonal direction with each other to jet the liquid, the first overlapping nozzle being included in the first execution nozzles and included in the first overlapping portion, the second overlapping nozzle being included in the second execution nozzles and included in the second overlapping portion.

The liquid jetting apparatus according to the present invention selects one of the first overlapping nozzle and the second overlapping nozzle based on the information of the drive voltages for the first execution nozzles and the second execution nozzles. Therefore, it is possible to restrain, in advance, the power sources driving the line head from heating up and from increasing in power consumption.

BRIEF DESCRIPTION OF THE DRAWINGS

FIG. 9 is a pair of tables showing an example of drive voltages and the number of execution nozzles at each drive voltage in an overlapping portion and a non-overlapping portion of head chips.

FIG. 10 is another pair of tables showing another example of the drive voltages and the number of execution nozzles at each drive voltage in the overlapping portion and the non-overlapping portion of the head chips.

DESCRIPTION OF THE PREFERRED EMBODIMENTS

A detailed explanation will be made below on a head and a printer including the head according to each embodiment of the present teaching.

[First Embodiment]

Figure 1:
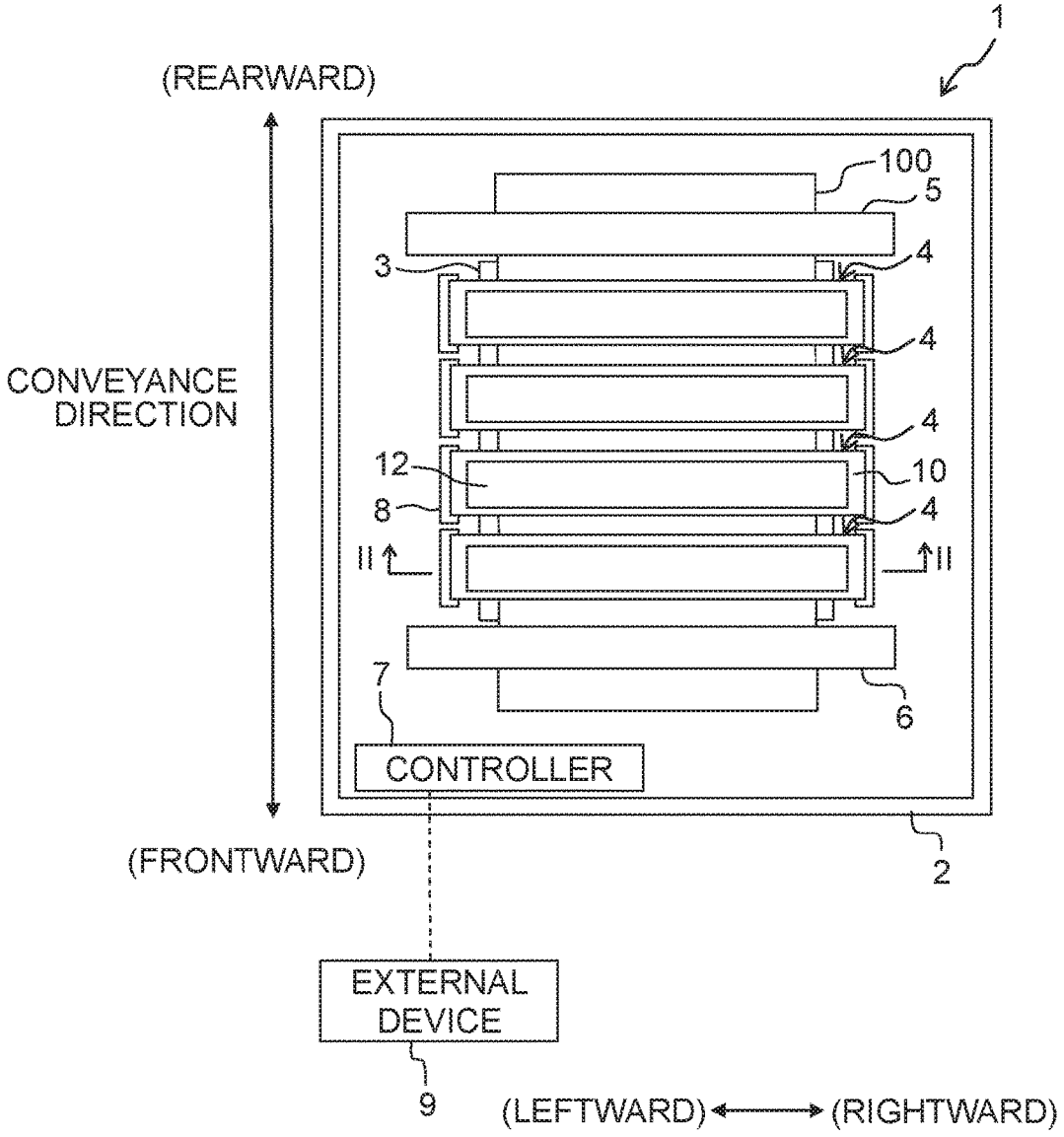
FIG. 1 is a plan view schematically showing a configuration of the main part of a printer according to a first embodiment of the present teaching.

As shown in FIG. 1, a printer 1 (an example of the liquid jetting apparatus) includes a conveyance roller 5 and a conveyance roller 6 to convey recording paper 100. The recording paper 100 is conveyed from the conveyance roller 5 to the conveyance roller 6. For the sake of explanatory convenience, the direction from the conveyance roller 5 toward the conveyance roller 6 will be referred to below as the conveyance direction. Further, with the printer 1, the downstream side in the conveyance direction is defined as the front side of the printer 1 while the upstream side in the conveyance direction is defined as the rear side of the printer 1.

Further, such a direction is defined as the left-right direction of the printer 1 as parallel to the surface (the surface parallel to the page of FIG. 1) of the recording paper 100 conveyed by the conveyance rollers 5 and 6 (an example of the conveyer) and intersecting the conveyance direction. In other words, in FIG. 1, the left side is the left side of the printer 1 while the right side is the right side of the printer 1. The left-right direction is the direction along which a plurality of nozzles 24 are arrayed as will be described later on.

Further, such a direction is defined as the up-down (upper-lower) direction of the printer 1 as orthogonal to the surface of the recording paper 100 (the direction perpendicular to the page of FIG. 1). That is, the front side of the page of FIG. 1 is the upper side while the back side is the lower side.

As shown in FIG. 1, the printer 1 includes a case 2, a platen 3, four ink jet heads 4, and a controller 7, in addition to the two conveyance rollers 5 and 6 mentioned above.

The platen 3 is flatly placed in the case 2 to support the recording paper 100 conveyed thereon. The recording paper 100 is conveyed to and carried on the upper surface of the platen 3.

The four ink jet heads 4 are arranged above the platen 3 and over the recording paper 100 conveyed thereunder. The four ink jet heads 4 are juxtaposed along the conveyance direction.

The two conveyance rollers 5 and 6 are arranged to interpose the four ink jet heads 4 therebetween in the conveyance direction. In more detail, the conveyance roller 5 is arranged on the upstream side from the ink jet heads 4 whereas the conveyance roller 6 is arranged on the downstream side from the ink jet heads 4, in the conveyance direction. The two conveyance rollers 5 and 6 are driven respectively by an unshown motor to convey the recording paper 100 to pass over the platen 3 to the front side of the printer 1.

Figure 2:
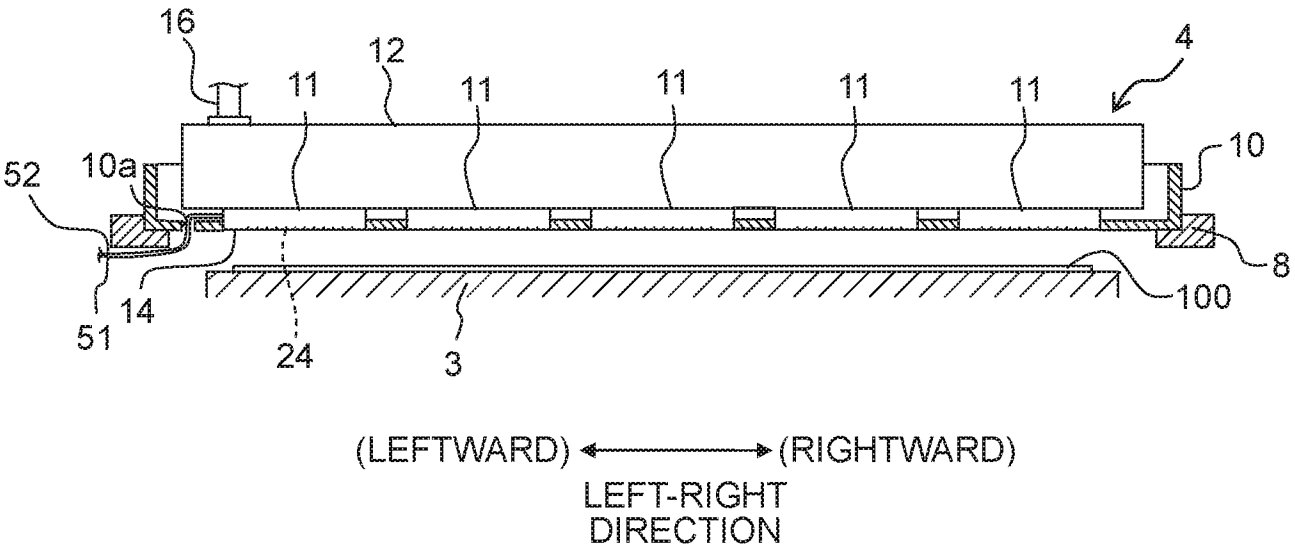
FIG. 2 is a cross-sectional view taken along the line 11-11 of FIG. 1.
Figure 3:
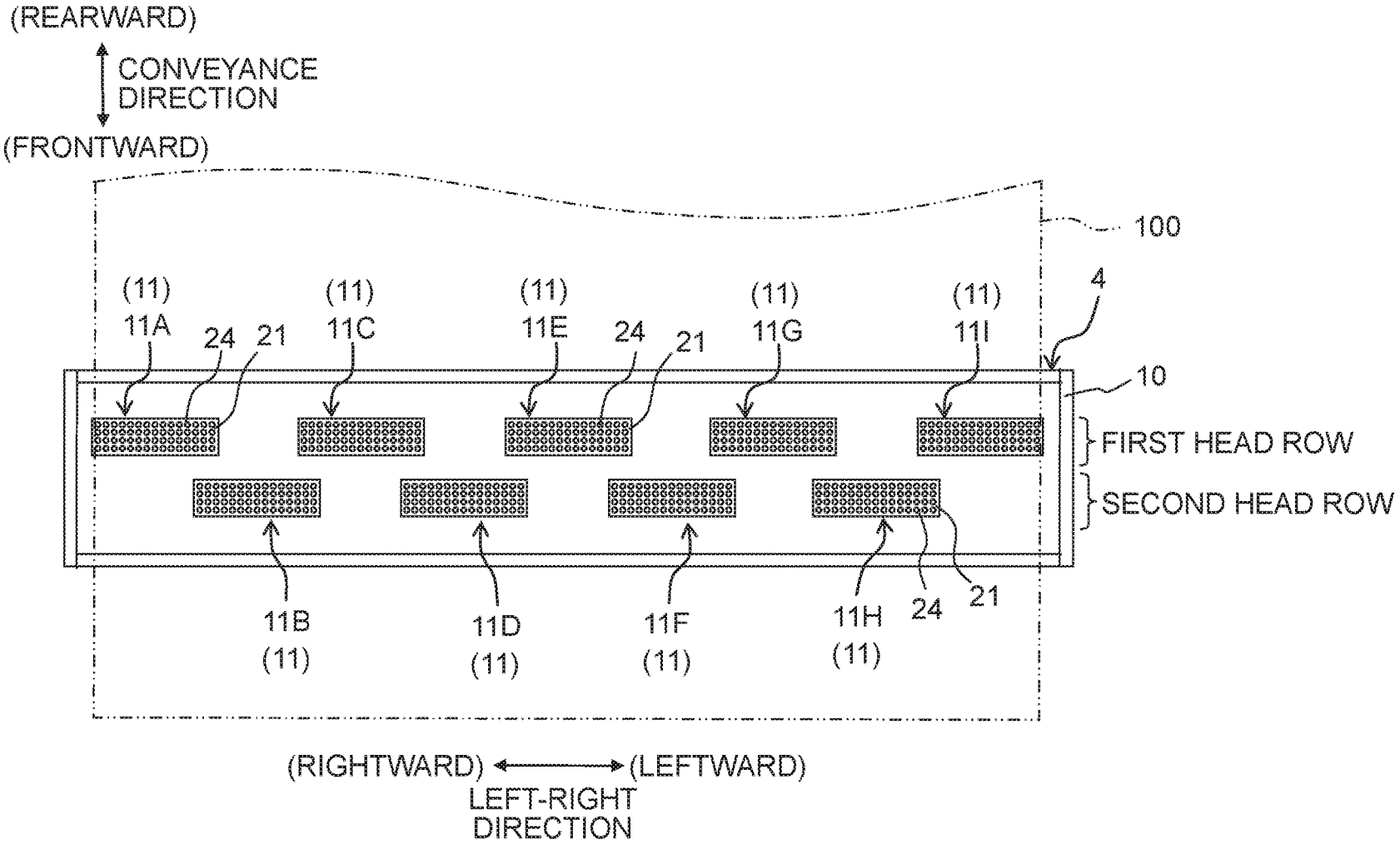
FIG. 3 is a bottom plan view of an ink jet head included in the printer according to the first embodiment.

As shown in FIGS. 2 and 3, each of the ink jet heads 4 is a so-called a line head extending in the left-right direction, including a holder 10 formed in a reed shape with the left-right direction as its longitudinal direction, and a plurality of head chips 11 fitted on the holder 10. Each of the plurality of head chips 11A to 11I is formed in a rectangular shape elongated along the longitudinal direction of the ink jet head 4, and arranged to separate alternately between the front side and the rear side in the conveyance direction. For example, the plurality of head chips 11A to 11I are arrayed in a staggered form along the longitudinal direction (the left-right direction) of the ink jet head 4.

In more detail, the head chips 11A, 11C, 11E, 11G and 11I form a first head row arrayed along the longitudinal direction (one direction) of the ink jet head 4, while the head chips 11B. 11D, 11F and 11H form a second head row arrayed along the longitudinal direction (one direction) of the ink jet head 4. The first head row and the second head row are arranged respectively on the front side and on the rear side in the conveyance direction. For the sake of explanatory convenience, the head chips 11A to 11I will also be simply referred to below as the head chips 11.

Each of the head chips 11 has a lower surface 21 formed with a plurality of nozzles 24. Each of the head chips 11 forms a nozzle row of juxtaposing the plurality of nozzles 24 along the left-right direction.

Figure 4:
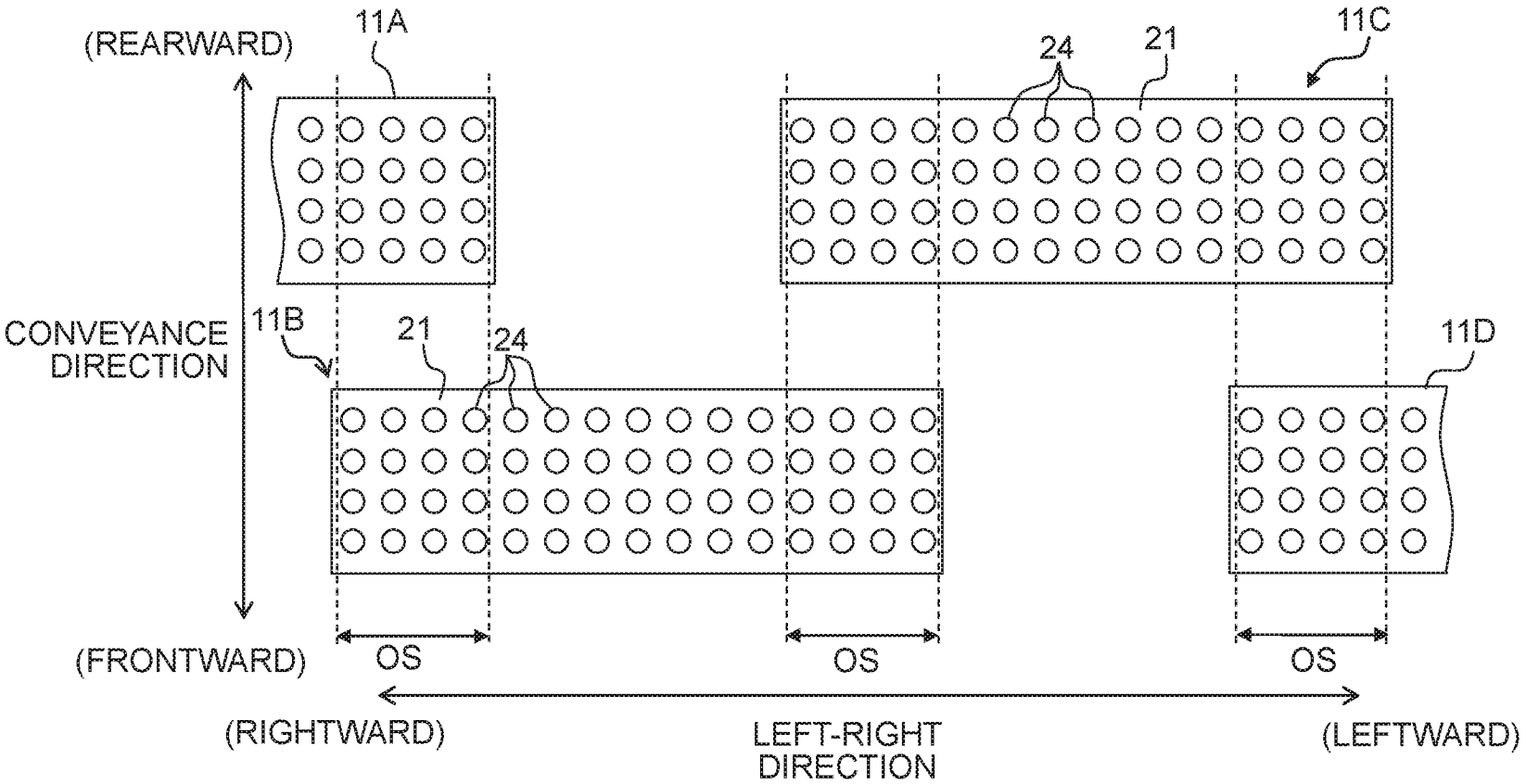
FIG. 4 is an explanatory diagram showing a positional relation between head chips of the printer according to the first embodiment.
Figure 5:
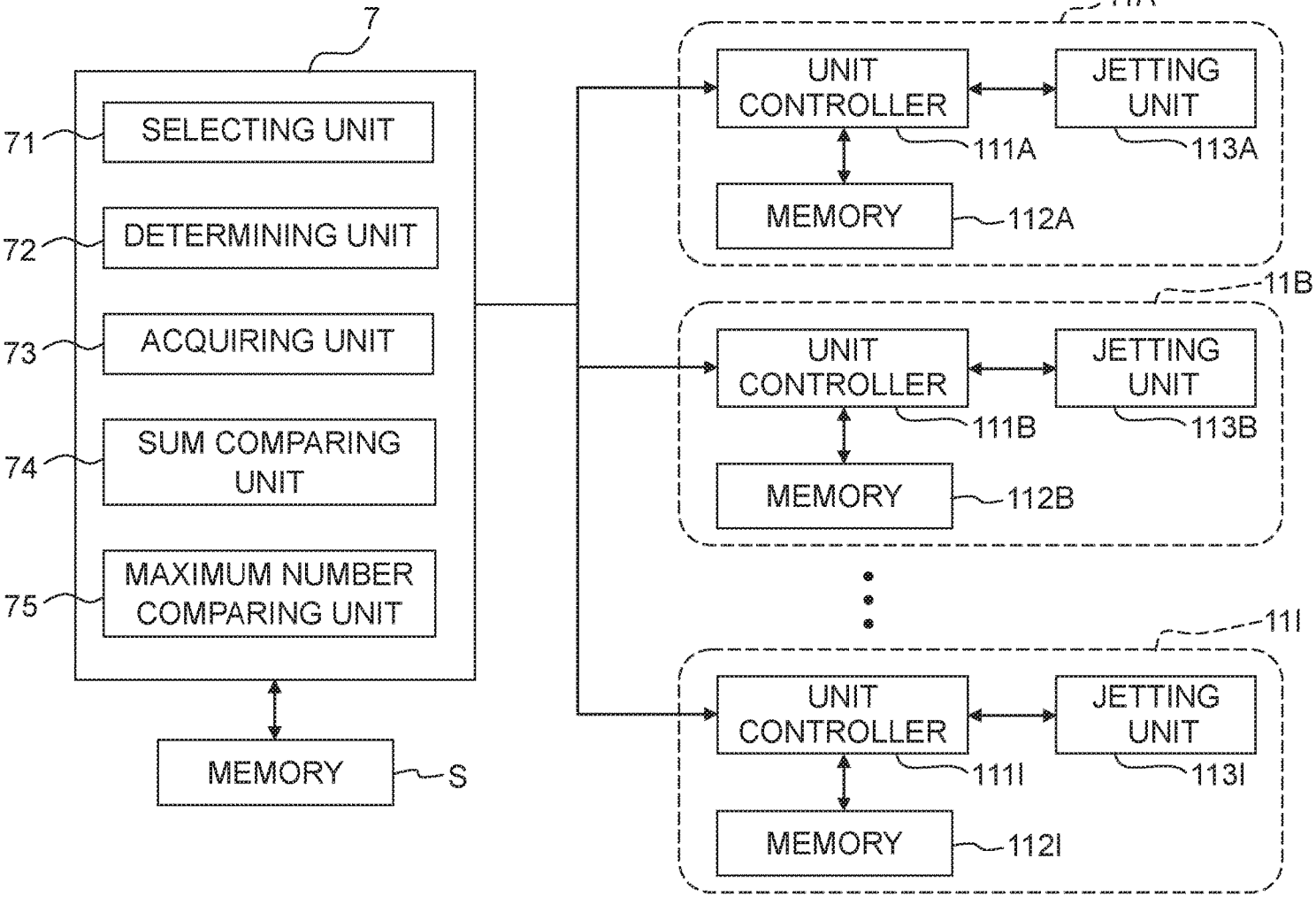
FIG. 5 is a functional block diagram showing a relation between the head chips and a controller in the printer according to the first embodiment.

In FIG. 4, for the sake of explanatory convenience, the head chip 11B (one head chip or the other head chip) and the head chip 11C (the other head chip or the one head chip) of FIG. 3 are taken as an example.

Each of the head chips 11A to 11I has a plurality of nozzle rows. These plurality of nozzle rows are juxtaposed in the conveyance direction.

Further, each of the head chips 11 has such a longitudinal end portion as arranged to overlap with an end portion of another vicinal head chip 11 in the conveyance direction.

For example, as shown in FIG. 4, the right end portion of the head chip 11C overlaps with the left end portion of the vicinal head chip 11B in the conveyance direction. In other words, the left end portion of the head chip 11B overlaps with the right end portion of the vicinal head chip 11C in the conveyance direction. In more detail, except the head chips 11A and 11I in the first head row at the two ends in the left-right direction, all the other head chips 11 each have an overlapping portion OS to overlap in the conveyance direction with another head chip 11 at the two end portions along the left-right direction.

On the other hand, the holder 10 is provided with a slit 10*a*. A flexible substrate 51 connects the head chips 11A to 11I and the controller 7. The flexible substrate 51 and a wire 52 are inserted through the slit 10*a*. That is, the slit 10*a* also functions as a hole for inserting the wire 52 therethrough.

As shown in FIGS. 1 and 2, a reservoir 12 is provided above the plurality of head chips 11A to 11I. The reservoir 12 is connected to an ink tank (not shown) via a tube 16 to temporarily retain the ink supplied from the ink tank. The reservoir 12 has a lower portion connected to the plurality of head chips 11A to 11I to supply the ink from the reservoir 12 to each of the head chips 11.

Inside the head chips 11A to 11I, each of the nozzles 24 is provided with a corresponding pressure chamber (not shown) and the ink is supplied to the pressure chamber. Further, each pressure chamber is provided with a PZT element to jet the ink in the pressure chamber via the nozzle 24, by way of the operation of the PZT element according to a voltage from an aftermentioned power source.

The controller 7 includes a CPU (Central Processing Unit), non-volatile memories such as a ROM (Read Only Memory), a RAM (Random Access Memory), an EEPROM (Electrically Erasable Programmable Read-Only Memory) and the like, and an ASIC (Application Specific Integrated Circuit) including various control circuits.

Further, the controller 7 is connected to an external device 9 such as a PC or the like in a data communicable manner to control the head chips 11A to 11I based on print job data sent from the external device 9. That is, based on the print job data, the controller 7 determines the head chips to execute the ink jetting (to be referred to below as execution head chips) and the nozzles (to be referred to below as execution nozzles), and controls the ink jetting according to the print job data.

The head chips 11A to 11I have unit controllers 111A to 111I, memories 112A to 112I, and jetting portions 113A to 113I, respectively.

The unit controllers 111A to 111I are, for example, FPGAs (Field Programmable Gate Array) or CPUs to control the jetting of each nozzle. Each of the memories 112A to 112I stores voltage information of each nozzle included in the corresponding head chip. Here, the voltage information refers to information of letting each nozzle correspond to the value of an applied voltage for driving the nozzle (to be referred to below as drive voltage).

On the other hand, as will be described later on, the printer 1 is provided with a plurality of power sources different in the voltage to apply, and each of the head chips 11 corresponds to a plurality of voltages. For the sake of explanatory convenience, the plurality of drive voltage values will be referred to below as a drive voltage group. Further, the voltage information includes the nozzle number of each drive voltage.

Further, the jetting portions 113A to 113I include respective nozzles 24, 24 . . . , and 24, and the pressure chambers for the respective nozzles 24. The unit controllers 111A to 111I of the head chips 11A to 11I are connected to the controller 7.

Further, the controller 7 is connected with a memory S. The memory S stores arrangement information denoting the arrangement of the head chips 11A to 11I in the ink jet head 4, and temporarily stores the data generated in the processing by the controller 7.

Further, the controller 7 has a selecting unit 71, a determining unit 72, an acquiring unit 73, a sum comparing unit 74, and a maximum number comparing unit 75.

The determining unit 72 determines the execution head chips 11 and the execution nozzles to execute the ink jetting based on the arrangement information stored in the memory S about the head chips 11A to 11I, according to the print job data.

The acquiring unit 73 acquires, from the corresponding memory 112, the drive voltages (the drive voltage group) of the execution nozzles included in the overlapping portion OS, with respect to each of two head chips 11 partially overlapping in the conveyance direction.

The sum comparing unit 74 compares the sums of the numbers of the execution nozzles, which are driven by the drive voltage group acquired by the acquiring unit 73 and arranged in the non-overlapping portion, with respect to each of the two head chips 11.

If the sums compared by the sum comparing unit 74 are the same, then the maximum number comparing unit 75 reads out the number of the execution nozzles included in the non-overlapping portion, with respect to each of the two head chips 11, for each drive voltage included in the drive voltage group, so as to specify the maximum value. Then, comparison is made between the maximum value of one of the two head chips 11 and the maximum value of the other of the two head chips 11.

The selecting unit 71 selects the overlapping portion OS included in any one of the two head chips 11 as the overlapping portion to execute the print job, based on the compared result by the sum comparing unit 74 or the maximum number comparing unit 75.

For example, in the case of FIG. 4, based on the compared result by the sum comparing unit 74, the selecting unit 71 selects the execution head chip to execute the print job with the smaller sum between the head chip 11B and the head chip 11C. Alternatively, based on the compared result by the maximum number comparing unit 75, the selecting unit 71 selects the execution head chip to execute the print job with the smaller maximum value between the head chip 11B and the head chip 11C.

Figure 6:
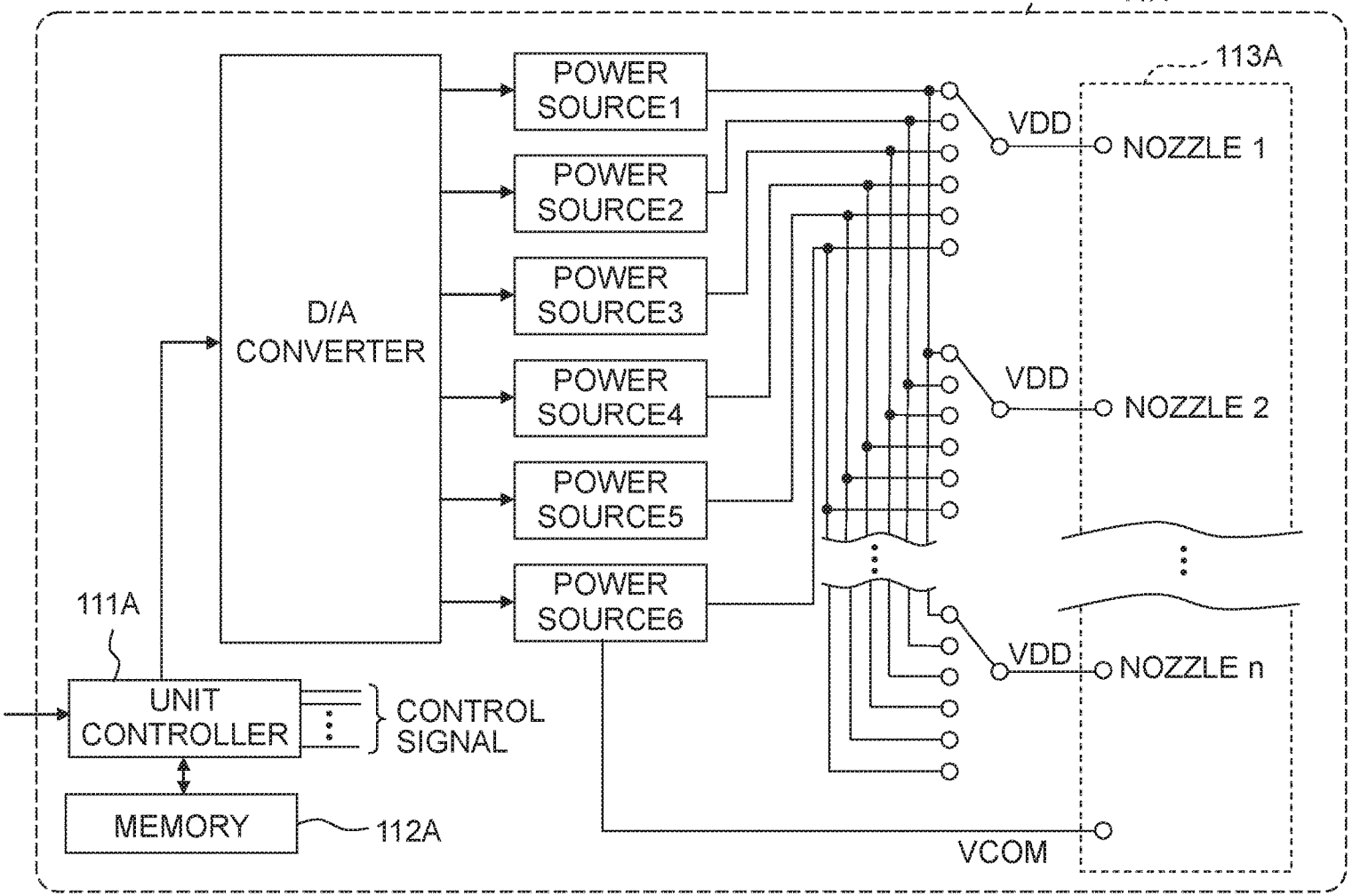
FIG. 6 is a functional block diagram showing a configuration of the main part of the head chip in the printer according to the first embodiment.

FIG. 6 shows an example of the head chip 11A. While the head chip 11A is taken as an explanatory example for the sake of explanatory convenience, much the same is true on the other head chips 11.

The head chip 11A has six power sources to apply voltages to the respective nozzles (1, 2, . . . , and n). In more detail, those six power sources apply the voltages to the PZT elements corresponding to the pressure chambers in communication with the nozzle holes.

Further, the six power sources are configured to apply different voltages. The six power sources are connected with the unit controller 111A via a D/A converter. The D/A converter converts the digital signals sent by the unit controller 111A into analog signals, and sends the same to the six power sources. Therefore, the unit controller 111A can instruct the power sources to change the voltages applied to the nozzles.

On the other hand, it is configured that each nozzle can selectively connect with any of the six power sources. In more detail, the voltage supply wires from the six power sources to the nozzles are branched as many as the number of nozzles, while the nozzles are connected respectively with the power sources via switch terminals corresponding to the six power sources. Thus, each nozzle is connected with any of the switch terminals, thereby being allowed to connect with any of the six power sources. The six power sources apply a drive voltage VDD and a potentiostatic voltage VCOM to the connected nozzles.

A plurality of head holding portions 8 are fitted in the case 2. The plurality of head holding portions 8 are juxtaposed above the platen 3 and between the two conveyance rollers 5 and 6 in the front-rear direction. The head holding portions 8 hold the ink jet heads 4, respectively.

The four ink jet heads 4 jet inks of four colors: cyan (C), magenta (M), yellow (Y), and black (K), respectively. Each of the ink jet heads 4 is supplied with the ink of the corresponding color from an unshown ink tank.

In the printer 1 having such configuration according to the first embodiment, the controller 7 controls a motor to drive the conveyance rollers 5 and 6 so as to cause the conveyance rollers 5 and 6 to convey the recording paper 100 in the conveyance direction, while controlling the ink jet heads 4 to jet the inks toward the recording paper 100. By virtue of this, image is printed on the recording paper 100.

Figure 7:
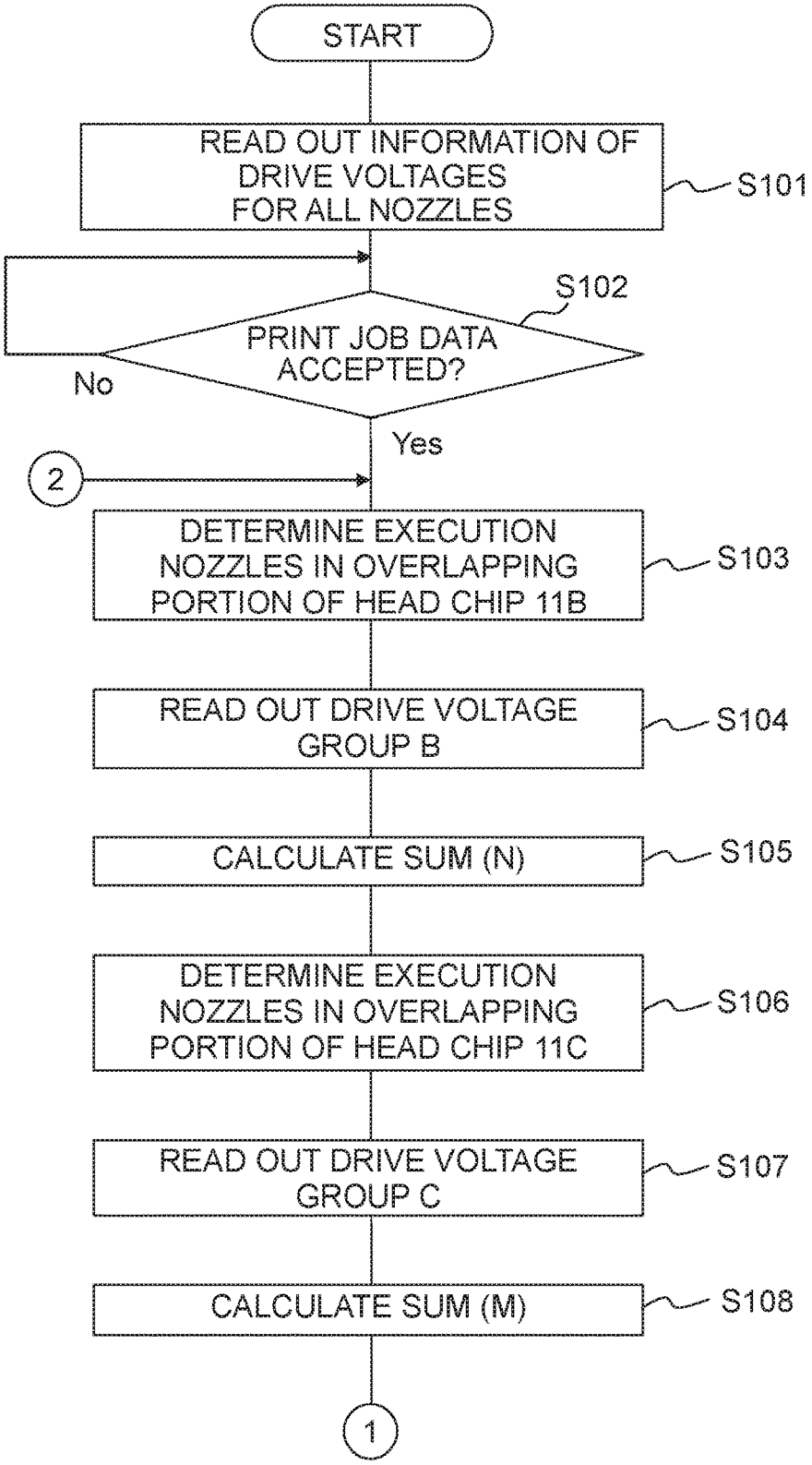
FIG. 7 is a part of a flowchart explaining a selection process for the head chip in the printer according to the first embodiment.
Figure 8:
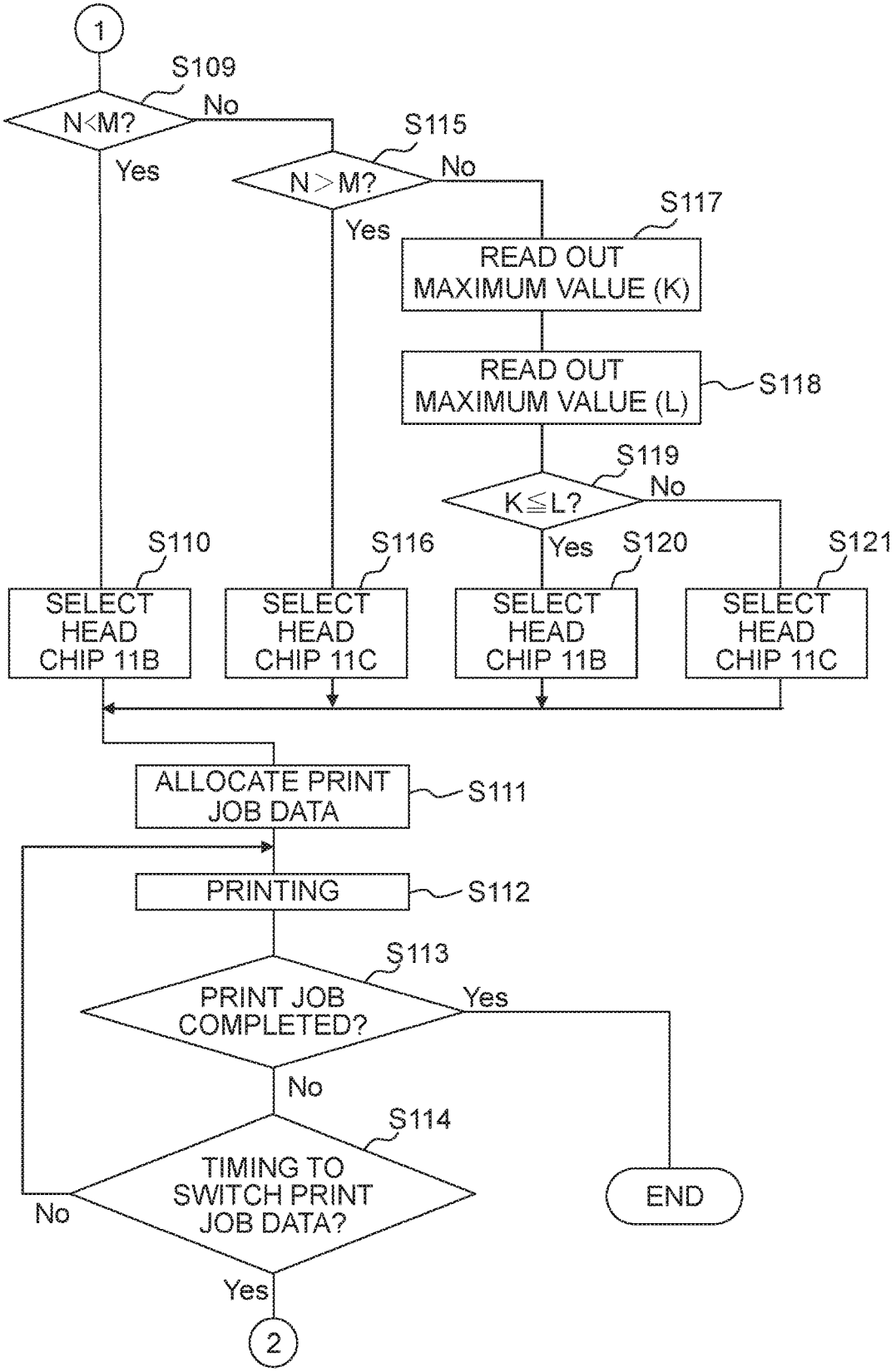
FIG. 8 is another part of the flowchart explaining the selection process for the head chip in the printer according to the first embodiment.

On the other hand, when printing is carried out, it is necessary to select any of the head chips 11 for the overlapping portion OS of the adjacent head chips 11. Referring to FIGS. 7 and 8, an explanation will be made below on a selection process by the controller 7 for the head chips 11.

For the sake of explanatory convenience, the explanation will be made based on FIG. 4 with an example of selecting any one of the head chips 11B and 11C.

For example, if a user turns on the power source (not shown) of the printer 1, then the controller 7 immediately reads out the drive voltage information about all nozzles of the head chips 11A to 11I from the memories 112A to 112I (step S101).

Next, the controller 7 determines whether or not the print job data are accepted by monitoring, for example, the connection wire between itself and the external device 9 (step S102). If it is determined that the print job data are not accepted (step S102: No), then the controller 7 repeats the process of the step S102 until the print job data are accepted.

Here, the print job data serve for forming dots of the respective colors YMCK constituting a predetermined image, including the positions of a recording medium to jet the inks thereon, and the amount of jetting the inks.

If it is determined that the print job data are accepted (step S102: Yes), then the determining unit 72 determines the execution nozzles included in the overlapping portion OS of the head chip 11B based on the print job data, for the case of using the head chip 11B (step S103).

Further, the acquiring unit 73 reads out from the memory 112B the drive voltages (the drive voltage group) of the execution nozzles included in the overlapping portion OS of the head chip 11B (step S104). The memory S stores the read-out drive voltage group (to be referred to below as drive voltage group B).

Next, the sum comparing unit 74 calculates the sum (N) of the numbers of the execution nozzles included in the non-overlapping portion of the head chip 11B and driven by the drive voltage group B in the head chip 11B, based on the drive voltage information read out in the step S101 (step S105).

Then, the determining unit 72 determines the execution nozzles included in the overlapping portion OS of the head chip 11C based on the print job data, for the case of using the head chip 11C (step S106).

Further, the acquiring unit 73 reads out from the memory 112C the drive voltages (the drive voltage group) of the execution nozzles included in the overlapping portion OS of the head chip 11C (step S107). The memory S stores the read-out drive voltage group (to be referred to below as drive voltage group C).

Next, the sum comparing unit 74 calculates the sum (M) of the numbers of the execution nozzles included in the non-overlapping portion of the head chip C and driven by the drive voltage group C, based on the drive voltage information read out in the step S101 (step S108).

Then, the sum comparing unit 74 compares the sum (N) and the sum (M) mentioned above, and determines whether or not the sum (N) is smaller than the sum (M) (step S109).

If it is determined that the sum (N) is smaller than the sum (M) (step S109: Yes), then the selecting unit 71 selects the overlapping portion OS of the head chip 11B as the overlapping portion to execute the print job (step S110). That is, the print job is carried out by the execution nozzles included in the overlapping portion OS of the head chip 11B.

On the other hand, if it is determined that the sum (N) is not smaller than the sum (M) (step S109: No), then the sum comparing unit 74 determines whether or not the sum (M) is smaller than the sum (N) (step S115).

If it is determined that the sum (M) is smaller than the sum (N) (step S115: Yes), then the selecting unit 71 selects the overlapping portion OS of the head chip 11C as the overlapping portion to execute the print job (step S116). That is, the print job is carried out by the execution nozzles included in the overlapping portion OS of the head chip 11C.

The following explanation will be made on the processes so far, referring to FIG. 9.

If the head chip 11B is used to carry out a certain print job, then suppose that the overlapping portion OS of the head chip 11B includes 5 execution nozzles with the drive voltage at 31V, 15 execution nozzles with the drive voltage at 28V, and 10 execution nozzles with the drive voltage at 26V. On the other hand, suppose that the non-overlapping portion of the head chip 11B includes 50 execution nozzles with the drive voltage at 31V, 250 execution nozzles with the drive voltage at 28V, and 100 execution nozzles with the drive voltage at 26V.

Further, if the head chip 11C is used to carry out the print job, then suppose that the overlapping portion OS of the head chip 11C includes 20 execution nozzles with the drive voltage at 28V, and 10 execution nozzles with the drive voltage at 26V. On the other hand, suppose that the non-overlapping portion of the head chip 11C includes 200 execution nozzles with the drive voltage at 28V, and 350 execution nozzles with the drive voltage at 26V.

In such a case, in the step S104, the acquiring unit 73 reads out 31V, 28V and 26V as the drive voltage group B. Further, the sum comparing unit 74 calculates the sum (N) of the numbers of the execution nozzles included in the non-overlapping portion of the head chip 11B and driven by the drive voltage group B, the calculated result being 400 (50+250+100).

Further, the acquiring unit 73 reads out 28V and 26V as the drive voltage group C. Then, the sum comparing unit 74 calculates the sum (M) of the numbers of the execution nozzles included in the non-overlapping portion of the head chip 11C and driven by the drive voltage group C, the calculated result being 550 (200+350).

Because the sum (N) is smaller than the sum (M), the selecting unit 71 selects the overlapping portion OS of the head chip 11B as the overlapping portion to execute the print job.

Next, the explanation will be returned again to FIG. 8. If it is determined that the sum (M) is not smaller than the sum (N) (step S115: No), that is, if the sum (N) is the same as the sum (M), then the maximum number comparing unit 75 reads out the numbers of the execution nozzles included in the non-overlapping portion of the head chip 11B according to each drive voltage included in the drive voltage group B, and specifies the maximum value (K) (step S117).

Next, the maximum number comparing unit 75 reads out the numbers of the execution nozzles included in the non-overlapping portion of the head chip 11C according to each drive voltage included in the drive voltage group C, and specifies the maximum value (L) (step S118).

Then, the maximum number comparing unit 75 compares the maximum value (L) with the maximum value (K), and determines whether or not the maximum value (L) is larger than or equal to the maximum value (K) (step S119).

If it is determined that the maximum value (L) is larger than or equal to the maximum value (K) (step S119: Yes), then the selecting unit 71 selects the overlapping portion OS of the head chip 11B as the overlapping portion to execute the print job (step S120).

On the other hand, if it is determined that the maximum value (L) is neither larger than nor equal to the maximum value (K) (step S119: No), then the selecting unit 71 selects the overlapping portion OS of the head chip 11C as the overlapping portion to execute the print job (step S121).

Referring to FIG. 10, an explanation will be made below on the processes from the step S117 to the step S121.

If the head chip 11B is used to carry out a certain print job, then suppose that the overlapping portion OS of the head chip 11B includes 5 execution nozzles with the drive voltage at 31V, 15 execution nozzles with the drive voltage at 28V, and 10 execution nozzles with the drive voltage at 26V. On the other hand, suppose that the non-overlapping portion of the head chip 11B includes 50 execution nozzles with the drive voltage at 31V, 400 execution nozzles with the drive voltage at 28V, and 100 execution nozzles with the drive voltage at 26V.

Further, if the head chip 11C is used to carry out the print job, then suppose that the overlapping portion OS of the head chip 11C includes 20 execution nozzles with the drive voltage at 28V, and 10 execution nozzles with the drive voltage at 26V. On the other hand, suppose that the non-overlapping portion of the head chip 11C includes 200 execution nozzles with the drive voltage at 28V, and 350 execution nozzles with the drive voltage at 26V.

In this case, the sum (N) of the numbers of the execution nozzles is 550 included in the non-overlapping portion of the head chip 11B and driven by the drive voltage group B, and the sum (M) of the numbers of the execution nozzles is also 550 included in the non-overlapping portion of the head chip 11C and driven by the drive voltage group C.

On this occasion, the maximum number comparing unit 75 reads out the numbers of the execution nozzles included in the non-overlapping portion of the head chip 11B according to each drive voltage included in the drive voltage group B, and specifies 400 as the maximum value (K). Further, the maximum number comparing unit 75 reads out the numbers of the execution nozzles included in the non-overlapping portion of the head chip 11C according to each drive voltage included in the drive voltage group C, and specifies 350 as the maximum value (L).

Because the maximum number comparing unit 75 determines that the maximum value (L) is neither larger than nor equal to the maximum value (K), the selecting unit 71 selects the overlapping portion OS of the head chip 11C as the overlapping portion to execute the print job. That is, the print job is executed by the execution nozzles included in the overlapping portion OS of the head chip 11C.

If the process is finished with any of the step S110, the step S116, the step S120 and the step S121, then the controller 7 allocates the accepted the accepted print job data to each of the execution head chips (step S111). That is, the controller 7 divides the print job data and sends the same to the unit controller of each execution head chip.

Thereafter, execution of the print job starts, that is, ink jetting starts based on the print job data with the execution head chips and the execution nozzles (step S112).

After a predetermined time is past, the controller 7 determines whether or not the print job is finished (step S113). If the controller 7 determines that the print job is finished (step S113: Yes), then the present process is ended.

On the other hand, if the controller 7 determines that the print job is not finished (step S113: No), then the controller 7 determines whether or not it is at the timing to switch the print job data (step S114). That is, the controller 7 determines whether or not to carry out the print job based on the next print job data following the present print job data.

If the controller 7 determines that it is not at the timing to switch the print job data (step S114: No), then the step S112 is carried out again. On the other hand, if the controller 7 determines that it is at the timing to switch the print job data (step S114: Yes), then the step S103 is carried out again.

The heat value of a power source is determined by the number of nozzles driven by the power source and the voltage of the power source. Hence, the more the number of driven nozzles, the larger the heat value of the power source. If the heat value of the power source is large, then the power source is liable to a shorter lifetime. Further, if the power source is arranged near the substrate of the unit controller or the memory, then the heat of the power source transfers to the substrate such that the substrate is also liable to a shorter lifetime. Further, due to the heat of the power source, the substrate is also liable to have noises whereby print defects may arise.

With the controller 7 of the printer 1 according to the first embodiment, if the overlapping portion to execute the print job is selected from the overlapping portion OS of two head chips 11, then there is calculated the sum of the numbers of the execution nozzles included in the non-overlapping portion of each head chip 11 and driven by the drive voltage group, to select the overlapping portion OS of the head chip 11 with the smaller sum.

Therefore, in carrying out the print job, it is possible to suppress the number of the execution nozzles driven by the drive voltage group and, as a result, it is possible to suppress the heat-up of the power source.

Further, the number of the execution nozzles included in the non-overlapping portion does not change even if any of the overlapping portions OS of the two head chips 11 is selected. Therefore, it is possible to more correctly estimate the heat value of each power source such that it is possible to prevent the load from being concentrated on one power source to cause an increase in heat value from that power source.

Further, the power source with the largest number of execution nozzles has a large heat value such that it is possible to give rise to problems due to heat-up. In the first embodiment, if there is the same sum of the execution nozzle numbers included in the non-overlapping portion of each head chip 11 and driven by the drive voltage group, then the number of the execution nozzles included in the non-overlapping portion of each head chip 11 is read out according to each drive voltage included in the drive voltage group, to specify the maximum value and select the overlapping portion OS of the head chip 11 with the smaller maximum value. By virtue of this, it is possible to prevent the load from being concentrated on one power source to cause an increase in heat value from that power source.

In the first embodiment, the execution nozzles are determined based on the print job data and, based on the number of the execution nozzles, the overlapping portion OS of the head chip 11 is selected to execute the print job. Therefore, it is possible to compare the nozzle allocations according to the actual printing such that it is possible to more correctly estimate the heat value of each power source according to each printing.

According to the first embodiment, if the overlapping portion to execute the print job is selected from the overlapping portion OS of two head chips 11, then there is calculated the sum of the numbers of the execution nozzles included in the non-overlapping portion of each head chip 11 and driven by the drive voltage group, to select the overlapping portion OS of the head chip 11 with the smaller sum. However, the printer according to the present teaching is not limited to this, but the controller may be configured to calculate the sum of the execution nozzles driven by the drive voltage group among all execution nozzles of each head chip 11, and select the overlapping portion OS of the head chip with the smaller sum.

Further, in the first embodiment, if there is the same sum of the execution nozzle numbers included in the non-overlapping portion of each head chip 11 and driven by the drive voltage group, then the number of the execution nozzles included in the non-overlapping portion of each head chip 11 is read out according to each drive voltage included in the drive voltage group, to specify the maximum value and select the overlapping portion OS of the head chip 11 with the smaller maximum value. However, the printer according to the present teaching is not limited to this, but the controller may be configured to omit the calculation process and the comparison process for the sums and only carry out the specification process for the maximum value so as to select the overlapping portion OS of the head chip 11 with the smaller maximum value.

In the first embodiment, six power sources are provided for each of the head chips 11A to 11I. However, the head chips 11A to 11I may share the six power sources.

Further, the abovementioned selecting unit 71, determining unit 72, acquiring unit 73, sum comparing unit 74, and maximum number comparing unit 75 may be either constructed from hardware logics or constructed from software for a CPU (not shown) to carry out predetermined programs.

[Second Embodiment]

Figure 11:
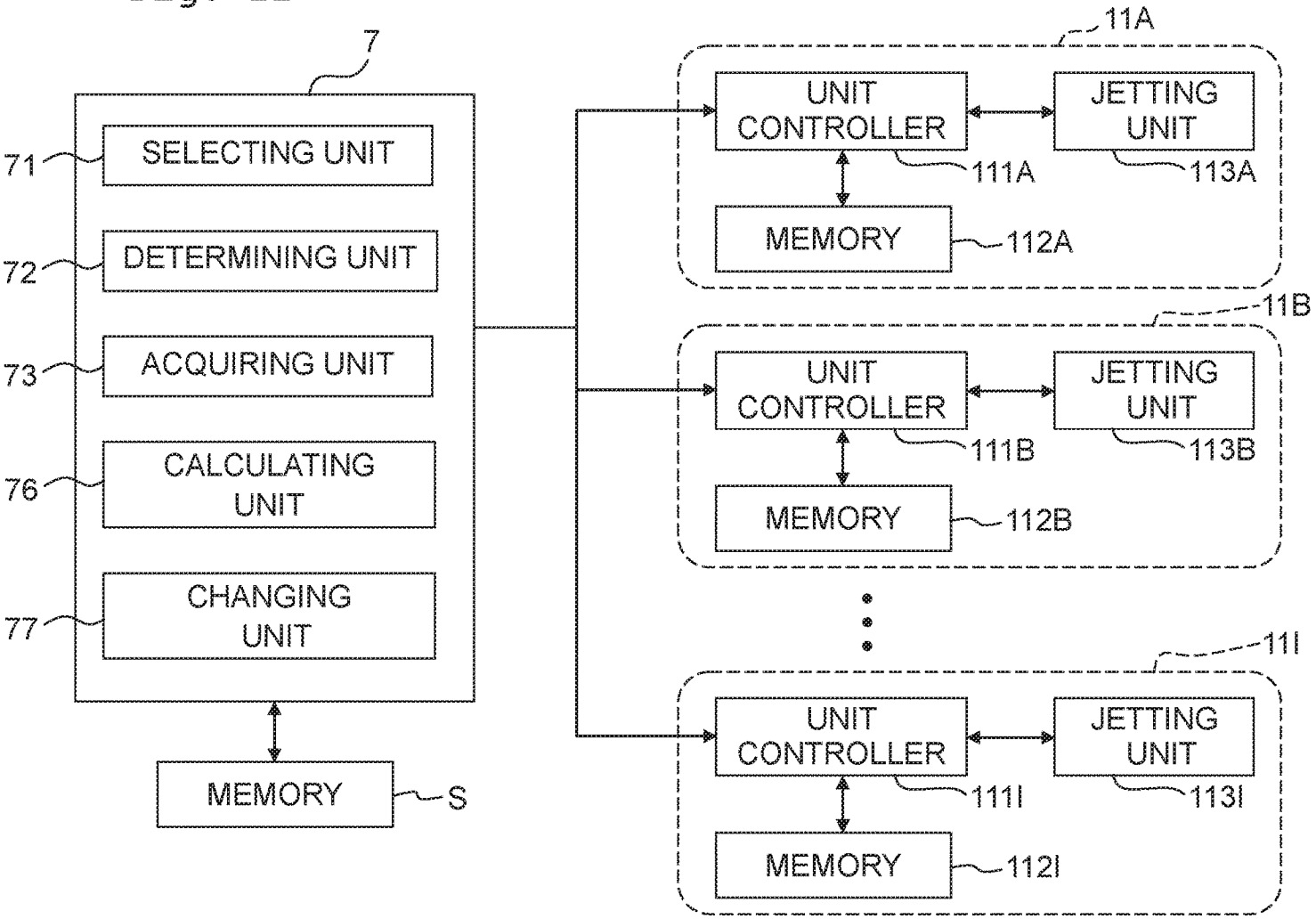
FIG. 11 is a functional block diagram showing a relation between the head chips and the controller in the printer according to a second embodiment.
Figure 12:
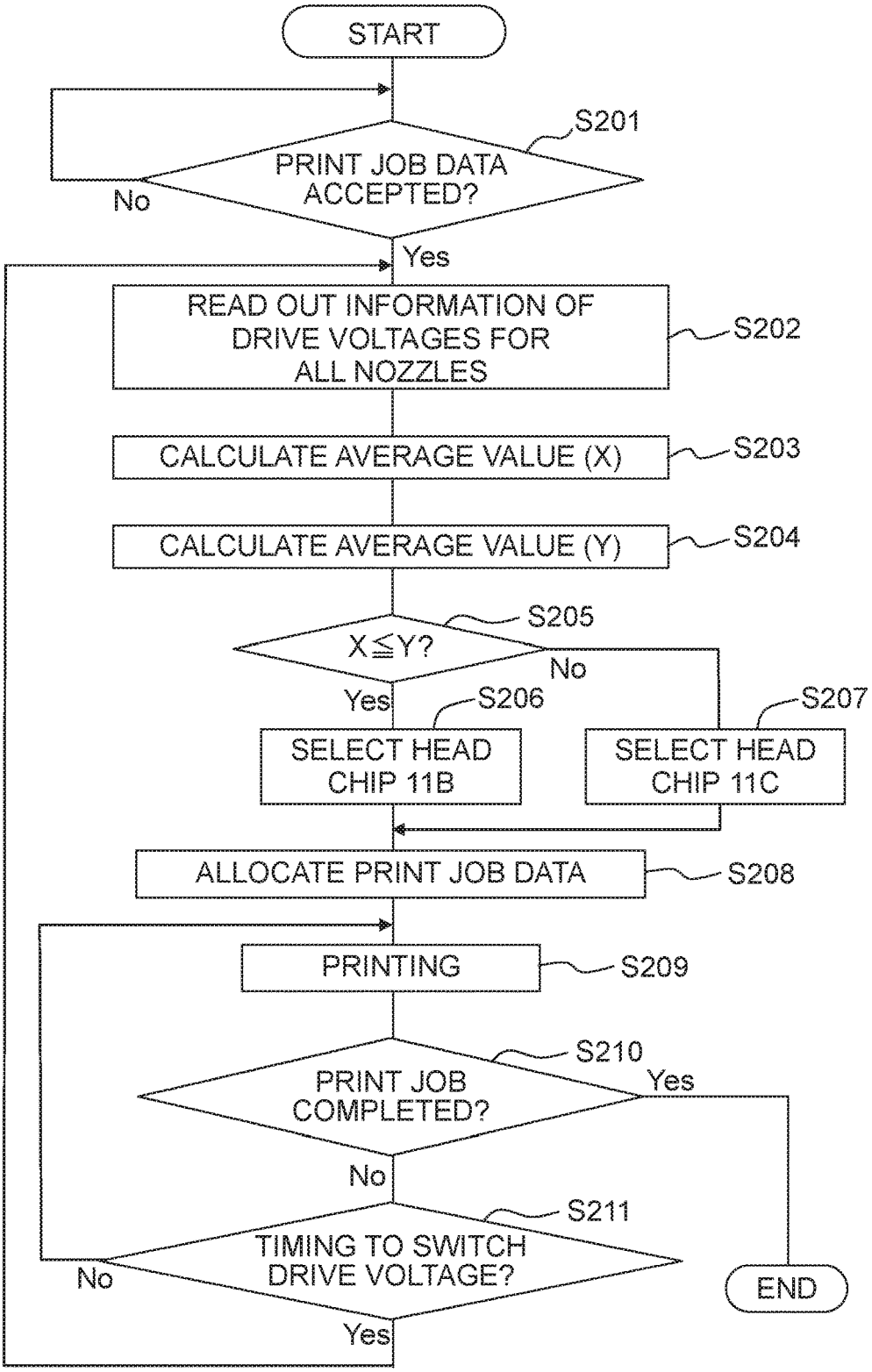
FIG. 12 is a flowchart explaining a selection process for the head chip in the printer according to the second embodiment.

Referring to FIGS. 11 and 12, a second embodiment will be explained. Further, the same numeral or alphanumeral is assigned to each of the components identical or similar in configuration and process to those in the first embodiment, and any detailed explanation therefor will be omitted.

As in the first embodiment, the controller 7 in the second embodiment has the selecting unit 71, the determining unit 72 and the acquiring unit 73 and, furthermore, has a calculation portion 76 and a changer portion 77.

The calculation portion 76 calculates an average value of the drive voltage for the execution nozzles included in the overlapping portion OS of each head chip 11.

The selecting unit 71 selects the overlapping portion OS of the head chip 11 with the smaller average value calculated by the calculation portion 76, as the overlapping portion to execute the print job.

The changer portion 77 changes the drive voltage according to a special condition related to the usage environment of the printer 1. The special condition refers to a predetermined range of a parameter value affecting the ink jetting. Further, the parameter is, for example, the ink temperature or the number of jets of the nozzle.

In particular, the changer portion 77 changes the drive voltage according to the ink temperature. For example, the changer portion 77 changes the predetermined drive voltage to 23V for the ink temperature from 23° C. to 24<C., to 22.5V if the ink temperature is from 24° C. to 25° C., to 22V if the ink temperature is from 25° C.; to 26° C., to 21.5V if the ink temperature is from 26° C. to 27° C., and to 21V if the ink temperature is from 27° C. to 28° C. Therefore, it is possible to correspond to the change in ink viscosity with the change in ink temperature.

If the ink viscosity decreases, then the jetting amount and the jetting speed increase at the same applied voltage. Hence, the quality of the printed image is affected such that it is not possible to obtain the image quality at a similar degree. On the other hand, by changing the voltage according to the change in ink viscosity, it is possible to maintain the image quality at the similar degree.

Further, the changer portion 77 changes the drive voltage according to the number of jets of the nozzle. For example, the drive voltage is increased by 0.5V each time the number of jets increases from the range of 10 to 20 billions to the range of 20 to 30 billions, the range of 30 to 40 billions, and the range of 40 to 50 billions, with reference to the case where the number of jets is from 0 to 10 billions from a certain nozzle. Hence, it is possible to deal with the problems (such as a decrease in the jetting speed of liquid droplets) due to deterioration of the nozzle.

If the number of nozzle jets increases, then the jetting amount and the jetting speed decrease at the same applied voltage. Hence, it is not possible to obtain the image quality at the similar degree because the quality of the printed image is affected. On the other hand, by changing the voltage according to the change in the number of jets of the nozzle, it is possible to maintain the image quality at the similar degree.

In detail, with reference to the drive voltage with the number of jets of the nozzle from 0 to 10 billions, the drive voltage is increased by 0.5V for the case of 10 to 20 billions, by 1.0V for the case of 20 to 30 billions, by 1.5V for the case of 30 to 40 billions, and by 2.0V for the case of 40 to 50 billions.

In the above manner, if the changer portion 77 changes the drive voltage, then the calculation portion 76 recalculates the average value and, based on the average value newly calculated by the calculation portion 76, the selecting unit 71 selects the overlapping portion to execute the print job.

By virtue of this, it is possible to correctly calculate the average value according to the change of the drive voltage and, even if the drive voltage is changed, it is still possible to accurately estimate the heat value of the power source. Hence, the present teaching achieves such an effect that even if the drive voltage is changed, it is still possible to suppress the heat-up of the power source.

Further, with the printer 1 according to the second embodiment, the head chips 11A to 11I have the unit controllers 111A to 111I, the memories 112A to 112I, and the jetting portions 113A to 113I, respectively. The unit controllers 111A to 111I control the jetting of the respective nozzles, and count the numbers of jets. The memories 112A to 112I store the numbers of jets of the nozzles counted by the unit controllers 111A to 111I.

Referring to FIG. 12, an explanation will be made on a selection process for the head chips 11 in the printer 1 according to the second embodiment. For the sake of explanatory convenience, the explanation will be made with an example of selecting any one of the overlapping portion OS of the head chip 11B and the overlapping portion OS of the head chip 11C based on FIG. 4.

The controller 7 determines whether or not the print job data are accepted by monitoring, for example, the connection wire between itself and the external device 9 (step S201). If it is determined that the print job data are not accepted (step S201: No), then the controller 7 repeats the process of the step S201 until the print job data are accepted.

If it is determined that the print job data are accepted (step S201: Yes), then the controller 7 reads out from the memories 112A to 112I the voltage information related to all nozzles of the head chips 11A to 11I (step S202).

Next, the determining unit 72 determines the execution nozzles in the overlapping portion OS of the head chip 11B and the overlapping portion OS of the head chip 11C based on the print job data. The acquiring unit 73 reads out from the memory 112B and the memory 112C, respectively, the drive voltage (drive voltage group B) for the execution nozzles included in the overlapping portions OS of the head chip 11B, and the drive voltage (drive voltage group C) for the execution nozzles included in the overlapping portions OS of the head chip 11C.

Further, based on the read-out voltage information, the calculation portion 76 calculates the average value (X) of the drive voltage for the execution nozzles included in the overlapping portion OS of the head chip 11B (step S203).

Subsequently, based on the read-out voltage information, the calculation portion 76 calculates the average value (Y) of the drive voltage for the execution nozzles included in the overlapping portion OS of the head chip 11C (step S204).

The selecting unit 71 determines whether or not the aforementioned average value (X) is less than or equal to the average value (Y) (step S205).

When determining the average value (X) is less than or equal to the average value (Y) (step S205: Yes), the selecting unit 71 selects the overlapping portion OS of the head chip 11B as the overlapping portion to execute the print job (step S206). That is, the print job is carried out by the execution nozzles included in the overlapping portion OS of the head chip 11B.

On the other hand, when determining the average value (X) is neither less than nor equal to the average value (Y) (step S205: No), the selecting unit 71 selects the overlapping portion OS of the head chip 11C as the overlapping portion to execute the print job (step S207). That is, the print job is carried out by the execution nozzles included in the overlapping portion OS of the head chip 11C.

The following explanation will be made on the processes so far, referring to FIG. 9.

If the head chip 11B is used to carry out a certain print job, then suppose that the overlapping portion OS of the head chip 11B includes 5 execution nozzles with the drive voltage at 31V, 15 execution nozzles with the drive voltage at 28V, and 10 execution nozzles with the drive voltage at 26V. On the other hand, if the head chip 11C is used to carry out that print job, then suppose that the overlapping portion OS of the head chip 11C includes 20 execution nozzles with the drive voltage at 28V and 10 execution nozzles with the drive voltage at 26V.

In such a case, in the step S203, the calculation portion 76 calculates the average value (X) of the drive voltage, which is 27.8V ((31V×5+28V×15+26V×10)/30), of the execution nozzles included in the overlapping portion OS of the head chip 11B. Further, in the step S204, the calculation portion 76 calculates the average value (Y) of the drive voltage, which is 27.3V ((28V×20+26V×10)/30), of the execution nozzles included in the overlapping portion OS of the head chip 11C.

Because the average value (Y) is smaller than the average value (X), the selecting unit 71 selects the overlapping portion OS of the head chip 11C as the overlapping portion to execute the print job.

Next, the explanation will be returned again to FIG. 12.

If the process is finished with any of the step S206 and the step S207, then the controller 7 allocates the accepted print job data to each of the execution head chips (step S208). That is, the controller 7 divides the print job data and sends the same to each of the unit controller of each execution head chip.

Thereafter, execution of the print job starts, that is, ink jetting starts based on the print job data with the execution head chips and the execution nozzles (step S209).

For example, after a predetermined time is past, the controller 7 determines whether or not the print job is finished (step S210). If the controller 7 determines that the print job is finished (step S210: Yes), then the present process is ended.

On the other hand, if the controller 7 determines that the print job is not finished (step S210: No), then the controller 7 determines whether or not it is at the timing to switch the print job data (step S211). This determination is carried out based on, as described earlier on, the ink temperature or the number of jets of the nozzle stored in the memories 112A to 112I.

If it is determined that it is not at the timing to switch the print job data (step S211: No), then the controller 7 carries out again the process from the step S209. On the other hand, if it is determined that it is at the timing to switch the print job data (step S211: Yes), then the controller 7 instructs the unit controllers 111A to 111I of the head chips 11A to 11I to change the drive voltages. Because changing the drive voltages have been already explained, detailed explanation will be omitted. Then, the controller 7 carries out again the process from the step S202.

That is, the calculation portion 76 recalculates the average value (X) of the drive voltage for the execution nozzles included in the overlapping portion OS of the head chip 11B, and the average value (Y) of the drive voltage for the execution nozzles included in the overlapping portion OS of the head chip 11C. Then, the selecting unit 71 selects the overlapping portion to execute the print job based on the average value (X) and the average value (Y).

With the controller 7 of the printer 1 according to the second embodiment, if the overlapping portion to execute the print job is selected from the overlapping portion OS of two head chips 11, then there is calculated the average value of the drive voltage group of each head chip 11, to select the overlapping portion OS of the head chip 11 with the smaller average value.

Hence, it is possible to lower the drive voltage during carrying out the print job, and it is also possible to reduce the drive current. As a result, it is possible to suppress the power consumption so as to more effectively carry out the print job. Further, because it is possible to lower the drive voltage, it is possible to suppress the heat value from the power source so as to elongate the lifetime of that power source. Further, as described earlier on, it is possible to prevent the heat from the power source from adversely affecting peripheral members such as the substrates and the like.

In the first embodiment, because the head chip with the smaller number of the execution nozzles is selected as the execution head chip to execute the print job after comparing the sums of the numbers of the execution nozzles of the non-overlapping portions using the drive voltages for the two head chips 11 related to the overlapping portion, it is possible to suppress the heat-up in the one head chip which is not selected. In contrast to this, in the second embodiment, the overlapping portion of the head chip with the smaller average value of the drive voltage group of the overlapping portion is selected. That is, if the overlapping portion with the smaller average value of the drive voltage group is selected, then it is possible to have a smaller average value of the drive voltage for the head chips 11B and 11C as a whole than the case of selecting the overlapping portion with the larger average value of the drive voltage. Hence, it is possible to suppress the heat-up of the power source of the head chips as a whole.

Further, the abovementioned calculation portion 76 and changer portion 77 may be either constructed from hardware logics or constructed from software for a CPU (not shown) to carry out predetermined programs.

The head chips and the printer according to the present teaching are not limited to the embodiments described above, but may be configured to select the head chip based on the drive voltages for the execution nozzles and other nozzles different from the execution nozzles.

Further, it may be configured to select the head chip based on the drive voltage for the nozzles included in the overlapping portion and/or the non-overlapping portion, and the number of the nozzles driven by the drive voltage.

Alternatively, it may be configured to select the head chip based only on the drive voltage for the nozzles included in the overlapping portion and/or the non-overlapping portion.

[Third Embodiment]

Next, a third embodiment will be explained. Further, the same numeral or alphanumeral will be assigned to each of the components identical or similar in configuration and process to those in the first embodiment, and any detailed explanation therefor will be omitted.

Figure 13:
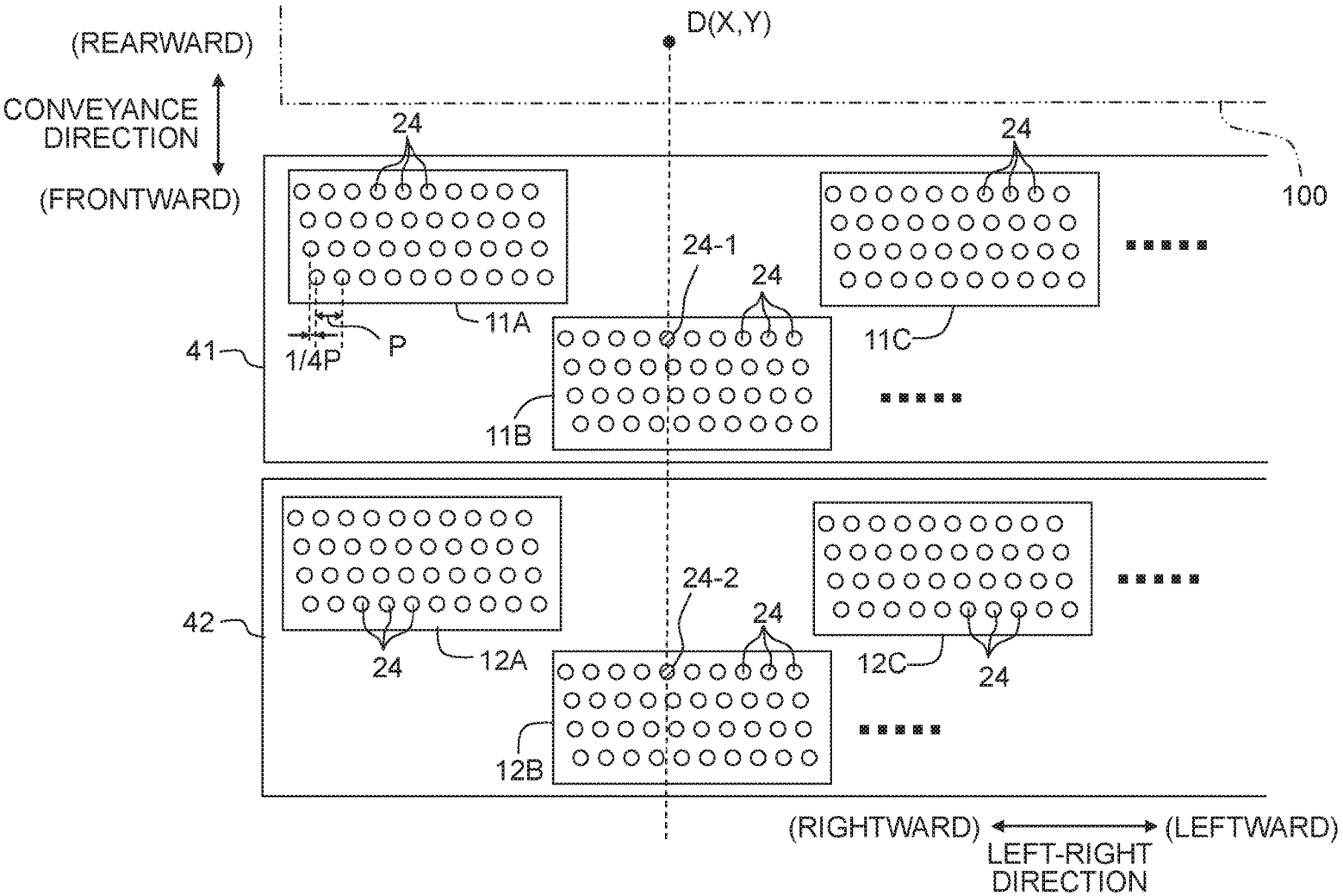
FIG. 13 is a conceptual diagram explaining a positional relation between a nozzle arrangement in an ink jet head included in a printer according to a third embodiment of the present teaching, and dots formed on recording paper.

The printer 1 in the third embodiment is provided with, for example, two ink jet heads 41 and 42 to jet the black ink used more frequently. As shown in FIG. 13, the ink jet heads 41 and 42 have the same structure, being arranged to align in the conveyance direction. The ink jet head 41 has nine head chips 11A to 11I. The ink jet head 42 also has nine head chips 12A to 12I. The head chips 11A to 11I have the same positions as the head chips 12A to 12I along the left-right direction, respectively. For example, the head chip 11A and the head chip 12A are arranged at the same positions with respect to the left-right direction, and overlap in the conveyance direction with each other.

Each of the head chips 11A to 11I and the head chips 12A to 12I has four nozzle rows aligning in the conveyance direction, and each of the nozzle rows is formed by a plurality of nozzles 24 arranged at a pitch P along the left-right direction. The four nozzle rows are arranged to slant leftward each by ¼ of the nozzle pitch (¼ P). Therefore, for example, the rearmost nozzle row of the head chip 11A along the conveyance direction has the same position along the left-right direction as, and overlaps in the conveyance direction with, the rearmost nozzle row of the head chip 12A along the conveyance direction.

Because the ink jet heads 41 and 42 are configured in the above manner, the ink jet heads 41 and 42 include the nozzles 24 each of which is able to form one dot at a desired position on the recording paper 100 along the left-right direction. For example, as shown in FIG. 13, the ink jet head 41 includes one nozzle 24-1 able to form a dot D at a desired position X on the recording paper 100 along the left-right direction, while the ink jet head 42 includes one nozzle 24-2 also able to form the dot D. That is, the nozzle 24-1 and the nozzle 24-2 have the same position along the left-right direction, overlapping in the conveyance direction with each other.

Here, the controller 7 of the third embodiment compares the drive voltages for the two nozzles 24-1 and 24-2 able to form such dot D, and selects the nozzle 24 at the lower drive voltage as the nozzle 24 to form the dot D. If the drive voltage for the nozzle 24-1 is the same as the drive voltage for the nozzle 24-2, then the controller 7 compares the average voltage of the drive voltage group of the head chip 11B to which the nozzle 24-1 belongs, with the average voltage of the drive voltage group of the head chip 12B to which the nozzle 24-2 belongs. Then, the controller 7 selects the nozzle 24 belonging to the head chip with the drive voltage group having the lower average voltage, as the nozzle 24 to form the dot D.

Figure 14A:
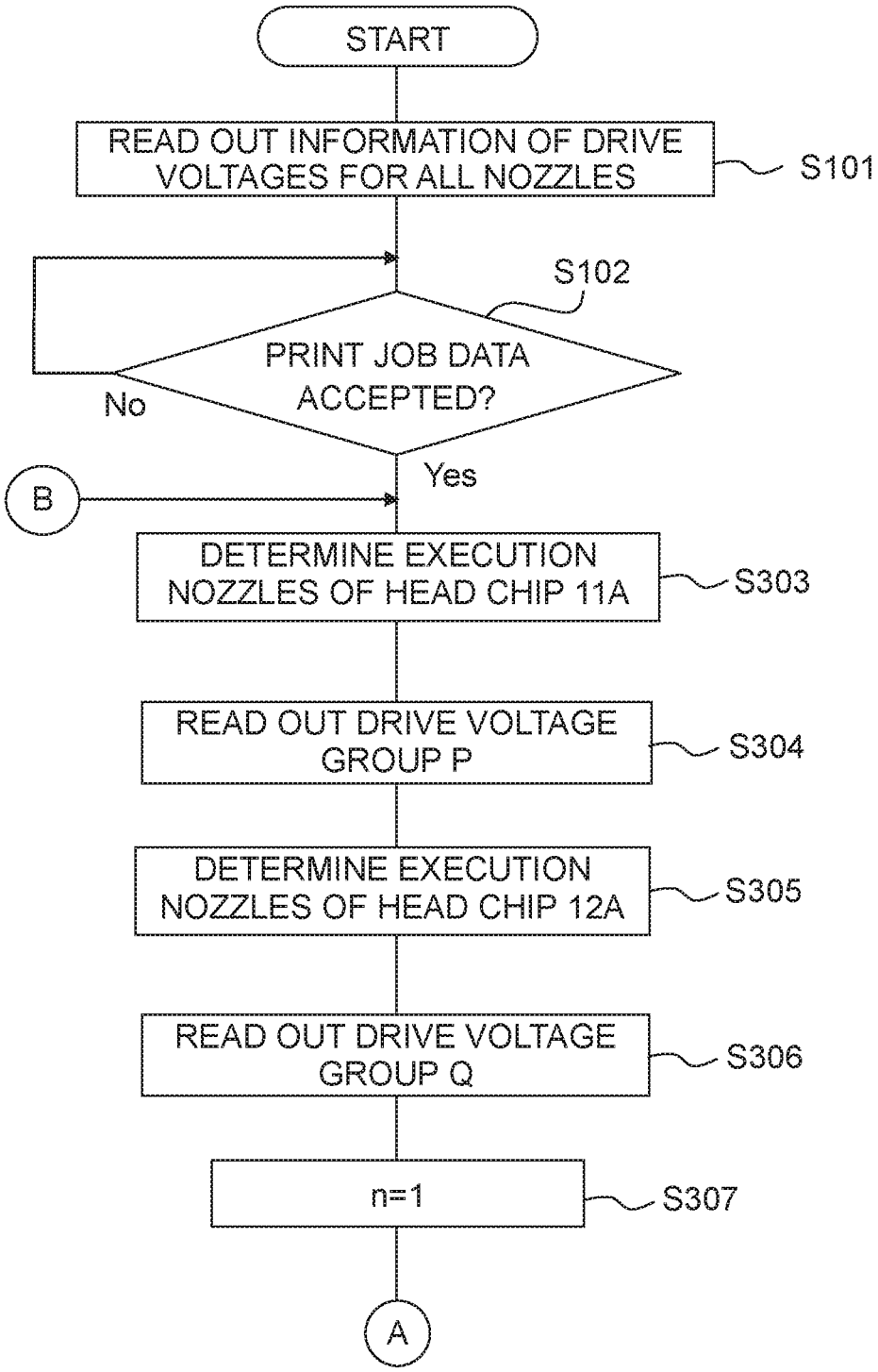
FIGS. 14A to 14C are flowcharts explaining a selection process in the printer according to the third embodiment.
Figure 14B:
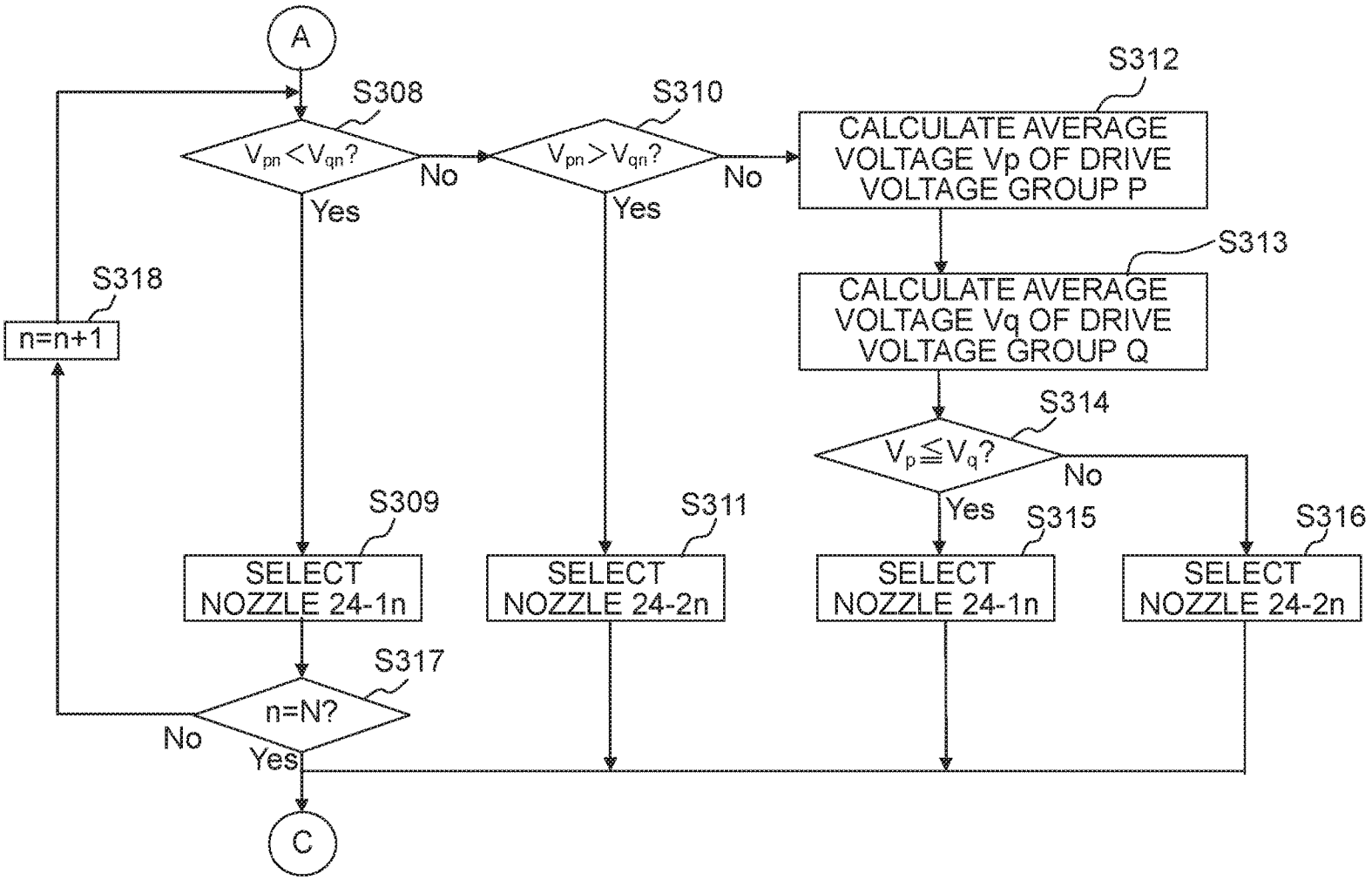
Figure 14C:
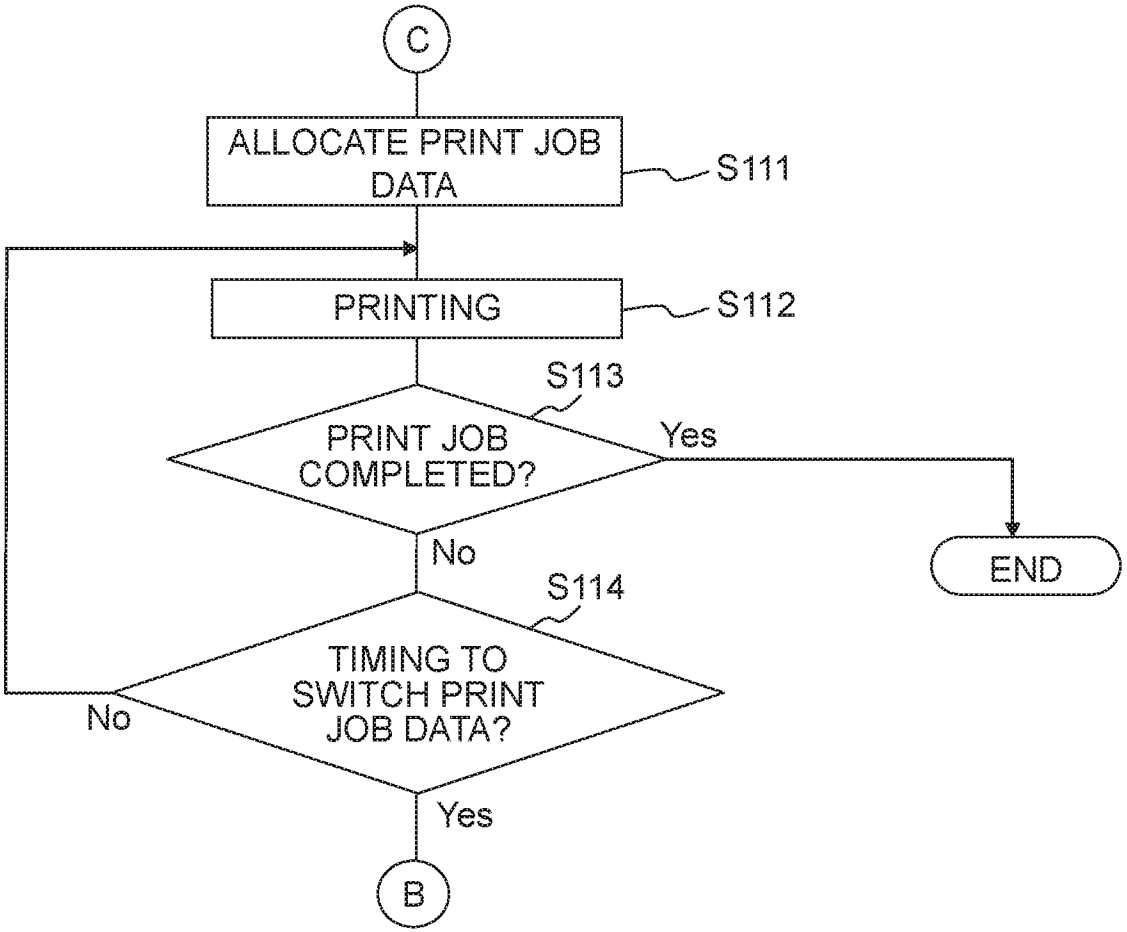
Figure 15:
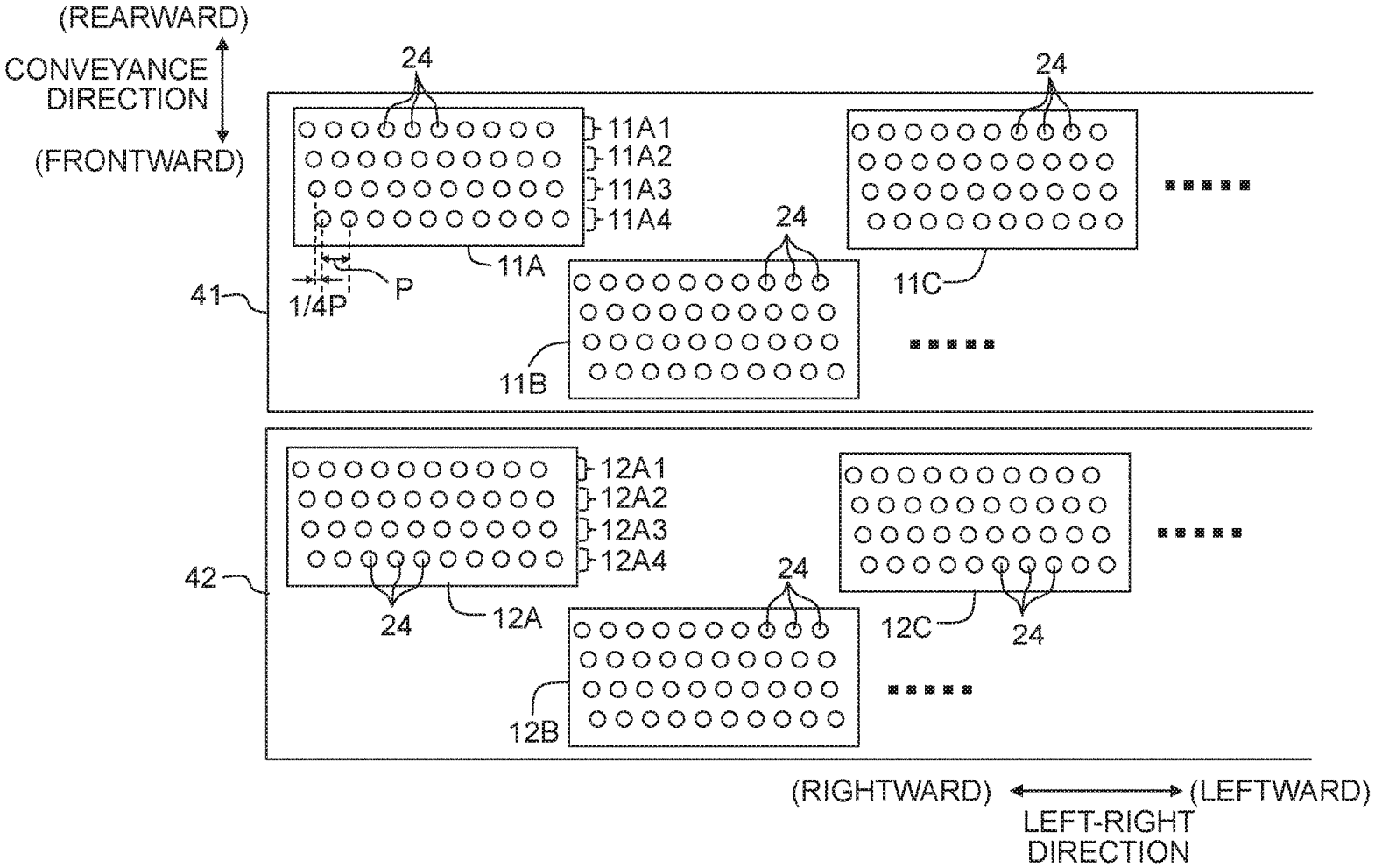
FIG. 15 is a partial bottom plan view of an ink jet head included in a printer according to a fourth embodiment of the present teaching.

Referring to FIGS. 14A to 14C, an explanation will be made below on a process by the controller 7 according to the third embodiment, exemplified by the head chips 11A and 12A overlapping in the conveyance direction with each other. Further, explanation will be omitted for the same process as in the first embodiment.

If it is determined that the print job data are accepted (step S102: Yes), then the controller 7 determines the execution nozzles included in the head chip 11A, supposing that the head chip 11A is used to print the accepted print job data (step S303). Then, the controller 7 reads out the drive voltages (drive voltage group P) for the determined execution nozzles from the memory provided in the head chip 11A (step S304). The memory S stores the read-out drive voltage group P. Next, the controller 7 determines the execution nozzles included in the head chip 12A, supposing that the head chip 12A is used to print the accepted print job data (step S305). Then, the controller 7 reads out the drive voltages (drive voltage group Q) for the determined execution nozzles from the memory provided in the head chip 12A (step S306). The memory S stores the read-out drive voltage group Q.

Here, suppose that, in the step S303, N numbers of nozzles 24 included in the head chip 11A are determined as the execution nozzles. Likewise, suppose that, in the step S305, N numbers of nozzles 24 included in the head chip 12A are determined as the execution nozzles. In the following explanation, the N nozzles 24 included in the head chip 11A will be called nozzles 24-11, 24-22-, . . . , and 24-1N in order from the nozzle arranged at the rightmost position. Further, the N nozzles 24 included in the head chip 12A will be called nozzles 24-21, 24-22-, . . . , and 24-2N in order from the nozzle arranged at the rightmost position. As described earlier on, the nozzles 24-11, 24-12-, . . . , and 24-1N have the same positions along the left-right direction as the nozzles 24-21, 24-22-, . . . , and 24-2N, respectively, overlapping in the conveyance direction with each other.

The controller 7 sets a parameter n to 1 (step S307), and determines whether or not a drive voltage Vpn for the nozzle 24-1*n* is lower than a drive voltage Vqn for the nozzle 24-2*n* (step S308). If it is determined that the drive voltage Vpn is lower than the drive voltage Vqn (step S308: Yes), then the controller 7 selects the nozzle 24-1*n* (step S309). If it is determined that the drive voltage Vpn is not lower than the drive voltage Vqn (step S308: No), then the controller 7 determines whether or not the drive voltage Vpn is higher than the drive voltage Vqn (step S310). If it is determined that the drive voltage Vpn is higher than the drive voltage Vqn (step S310: Yes), then the controller 7 selects the nozzle 24-2*n* (step S311).

If it is determined that the drive voltage Vpn is not higher than the drive voltage Vqn, that is, if it is determined that the drive voltage Vpn is equal to the drive voltage Vqn, (step S310: No), then the controller 7 calculates an average voltage Vp of the drive voltage group P (step S312). Further, the controller 7 calculates an average voltage Vq of the drive voltage group Q (step S313). Then, the controller 7 determines whether or not the average voltage Vp is lower than or equal to the average voltage Vq (step S314). If it is determined that the average voltage Vp is lower than or equal to the average voltage Vq (step S314: Yes), then the controller 7 selects the nozzle 24-1*n* (step S315). If it is determined that the average voltage Vp is higher than the average voltage Vq (step S314: No), then the controller 7 selects the nozzle 24-2*n* (step S316).

If any of the step S309, step S311, step S315 and step S316 is finished, then the controller 7 determines whether or not the value of the parameter n is N (step S317). If it is determined that the value of the parameter n is not N (step S317: No), then the controller 7 increments the value of the parameter n (step S318), and carries out again the process from the step S308. If it is determined that the value of the parameter n is N (step S317: Yes), then the controller 7 carries out the process from the step S111 as in the first embodiment.

The ink jet heads 41 and 42 in the third embodiment include the nozzles 24 each of which is able to form a dot at a desired position on the recording paper 100 along the left-right direction. Therefore, if a dot is formed at a desired position on the recording paper 100 along the left-right direction, then the controller 7 compares the drive voltages of the two nozzles 24 and selects the nozzle 24 at the lower drive voltage. By virtue of this, it is possible to reduce the drive current, thereby allowing for suppression of the power consumption of the printer 1 as a whole.

In the third embodiment, each of the head chips 11A to 11I and the head chips 12A to 12I has four nozzle rows aligning in the conveyance direction, and the four nozzle rows are arranged to slant leftward each by ¼ of the nozzle pitch (¼ P). However, without being limited to this configuration, the four nozzle rows may have the same position along the left-right direction. That is, the four nozzle rows may overlap in the conveyance direction with one another. In this case, the ink jet heads 41 and 42 include the nozzles 24 every four of which are able to form a dot at a desired position on the recording paper 100 along the left-right direction. Therefore, in the step S308, the controller 7 may compare the average value of the drive voltages for four nozzles included in the head chip 11A with the average value of the drive voltages for four nozzles included in the head chip 12A, instead of comparing the drive voltage for one nozzle included in the head chip 11A with the drive voltage for one nozzle included in the head chip 12A.

In the third embodiment, if the drive voltage for the nozzle 24-1*n* is equal to the drive voltage for the nozzle 24-2*n* (step S310: No), then the average value of the drive voltage group P is compared with the average value of the drive voltage group Q (steps S312 to S314). However, without being limited to these processes, the controller 7 may compare the average value of the drive voltages for all the nozzles 24 included in the head chip 11A with the average value of the drive voltages for all the nozzles 24 included in the head chip 11B.

Further, the abovementioned controller 7 may be either constructed from hardware logics or constructed from software for a CPU (not shown) to carry out predetermined programs.

[Fourth Embodiment]

Next, a fourth embodiment will be explained. Further, the same numeral or alphanumeral will be assigned to each of the components identical or similar in configuration and process to those in the third embodiment, and any detailed explanation therefor will be omitted.

The printer 1 of the fourth embodiment includes the ink jet heads 41 and 42 of the third embodiment. The head chips 11A to 11I have the same positions as the head chips 12A to 12I along the left-right direction, respectively. Further, each of the head chips 11A to 11I and the head chips 12A to 12I has four nozzle rows aligning in the conveyance direction, and the four nozzle rows are arranged to slant leftward each by ¼ of the nozzle pitch (¼ P). Therefore, for example, the nozzle row 11An in the head chip 11A. i.e., the nth (n=1, 2, 3, or 4) row from the rear end along the conveyance direction, has the same position along the left-right direction as the nozzle row 12An in the head chip 12A, i.e., the nth row from the rear end along the conveyance direction, overlapping in the conveyance direction with each other.

Here, the controller 7 of the fourth embodiment compares the average values of the nozzles 24 belonging to the nozzle rows between the two nozzle rows 11An and 12An overlapping in the conveyance direction with each other, and selects the nozzle row with the smaller average value of the drive voltages as the nozzle row to jet the ink. If the average value of the drive voltages for the nozzle row 11An is the same as the average value of the drive voltages for the nozzle row 12An, then the controller 7 compares the average value of the drive voltages for all the nozzles 24 included in the head chip 11A with the average value of the drive voltages for all the nozzles 24 included in the head chip 12A. Then, the controller 7 selects the nozzle row belonging to the head chip with the smaller average value of the drive voltages for all the nozzles 24 as the nozzle row to jet the ink.

Figure 16A:
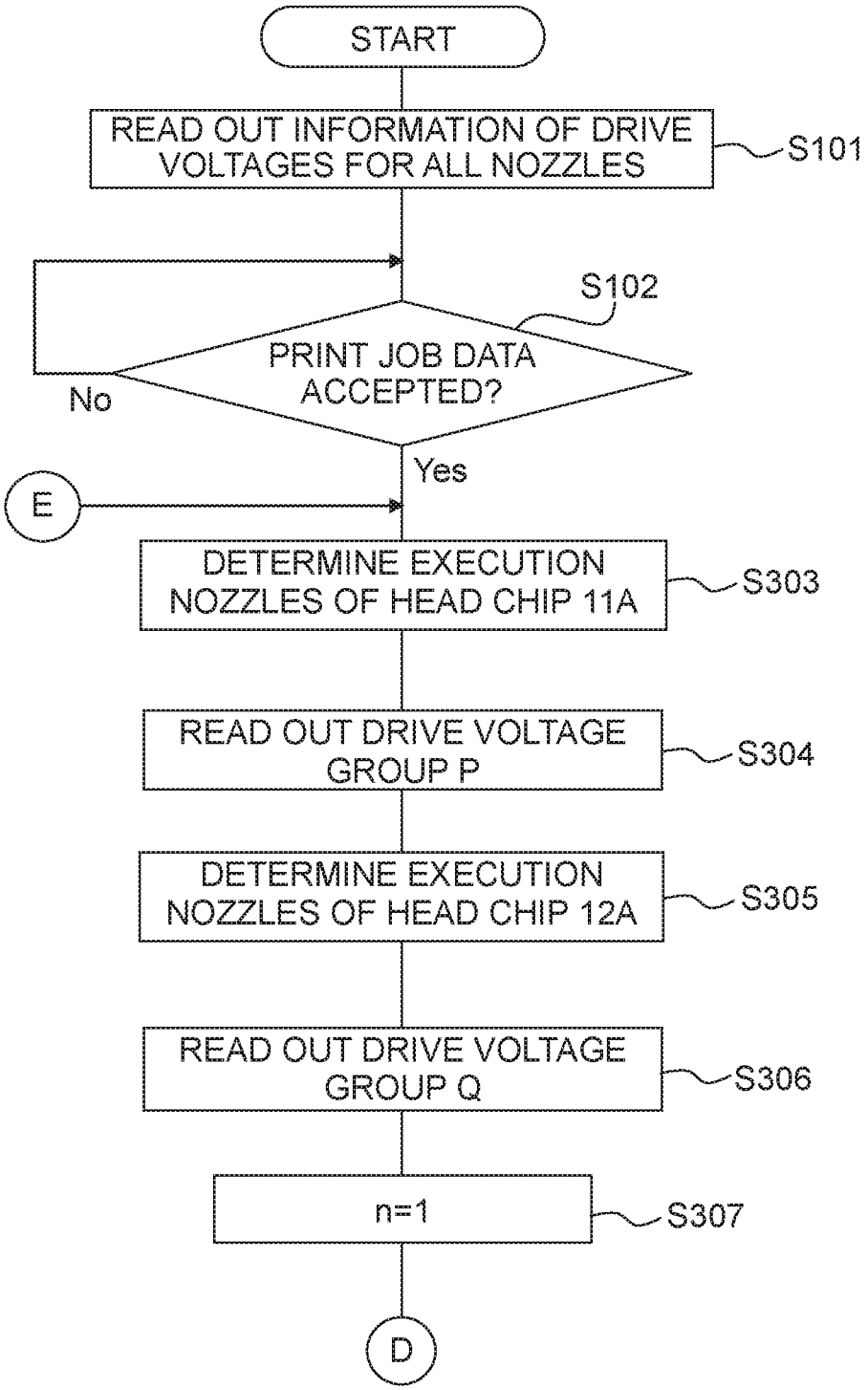
FIGS. 16A to 16C are flowcharts explaining a selection process in the printer according to the fourth embodiment.
Figure 16B:
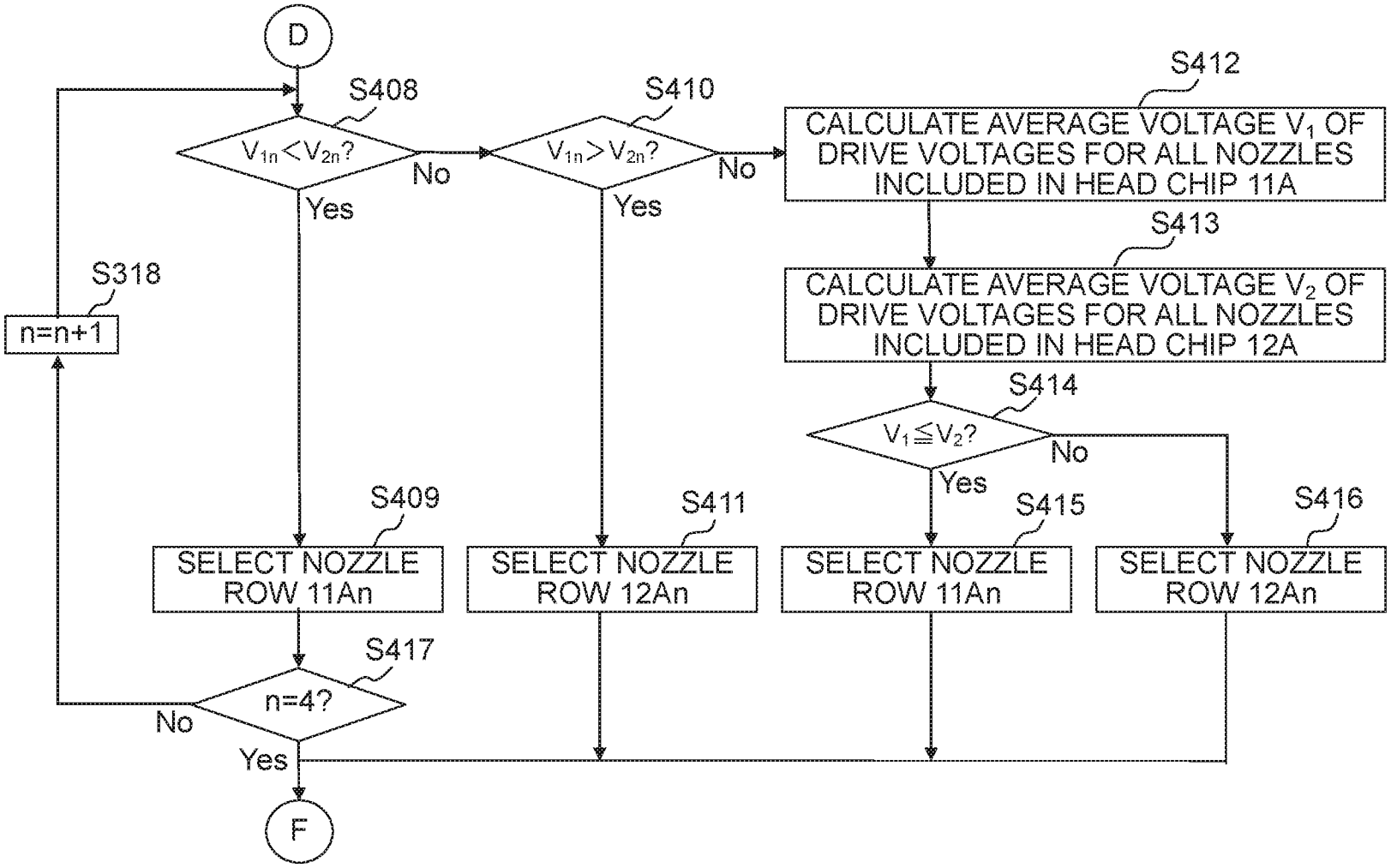
Figure 16C:
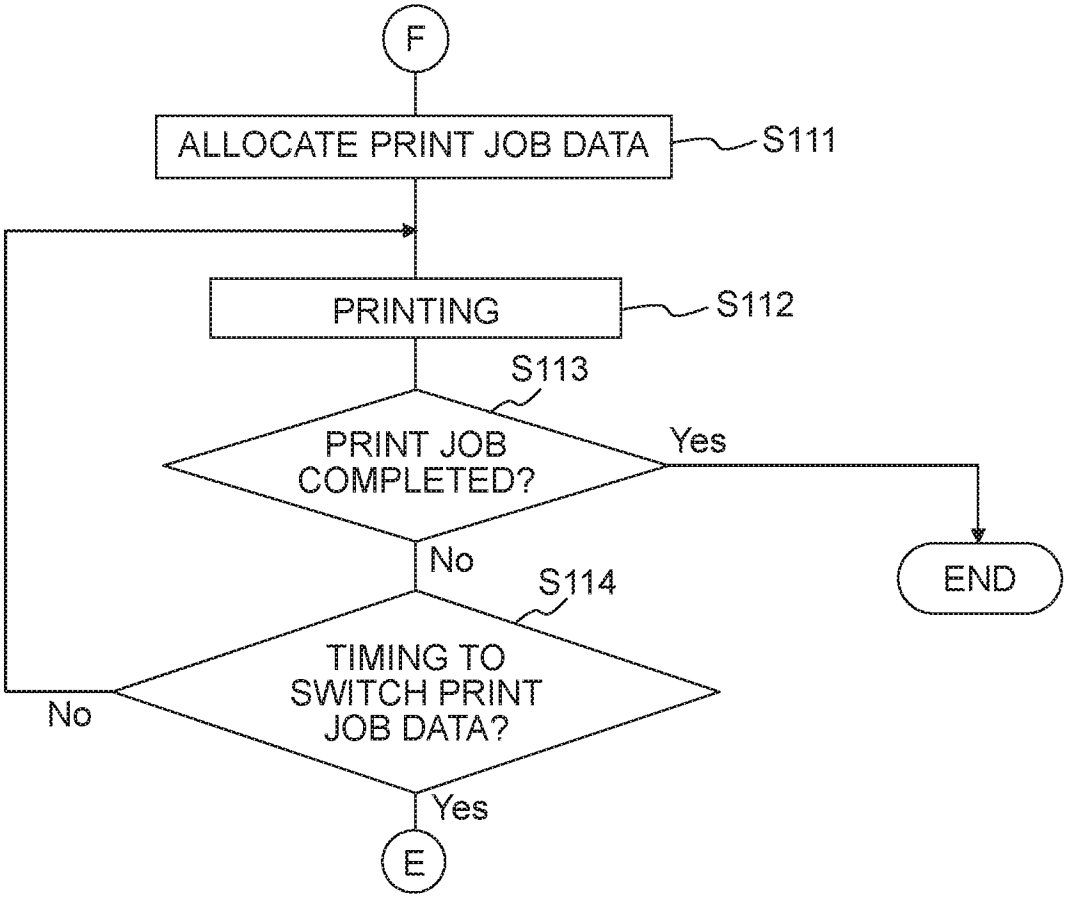

Referring to FIGS. 16A to 16C, an explanation will be made below on a process by the controller 7 according to the fourth embodiment, exemplified by the head chips 11A and 12A overlapping in the conveyance direction with each other. Further, explanation will be omitted for the same process as in the third embodiment.

After carrying out the processes of the step S101 to the step S307, the controller 7 determines whether or not an average value $V_1n$ of the drive voltages for all the nozzles 24 included in the nozzle row 11An is smaller than an average value $V_2n$ of the drive voltages for all the nozzles 24 included in the nozzle row 12An (step S408). If it is determined that the average value $V_1n$ is smaller than the average value $V_1n$ (step S408: Yes), then the controller 7 selects the nozzle row 11An (step S409). If it is determined that the average value $V_1n$ is not smaller than the average value $V_2n$ (step S408: No), then the controller 7 determines whether or not the average value $V_1n$ is larger than the average value $V_2n$ (step S410). If it is determined that the average value $V_1n$ is larger than the average value $V_2n$ (step S410: Yes), then the controller 7 selects the nozzle row 12An (step S411).

If it is determined that the average value $V_1n$ is not larger than the average value $V_2n$, that is, if it is determined that the average value $V_1n$ is equal to the average value $V_2n$, (step S410: No), then the controller 7 calculates an average value $V_1$ of the drive voltages for all the nozzles 24 included in the head chip 11A (step S412). Further, the controller 7 calculates an average value $V_2$ of the drive voltages for all the nozzles 24 included in the head chip 12A (step S413). Then, the controller 7 determines whether or not the average value $V_1$ is less than or equal to the average value $V_2$ (step S414). If it is determined that the average value $V_1$ is less than or equal to the average value $V_2$ (step S414: Yes), then the controller 7 selects the nozzle row 11An (step S415). If it is determined that the average value $V_1$ is larger than the average value $V_2$ (step S414: No), then the controller 7 selects the nozzle row 12An (step S416).

If any of the step S409, step S411, step S415 and step S416 is finished, then the controller 7 determines whether or not the value of the parameter n is 4 (step S417). If it is determined that the value of the parameter n is not 4 (step S417: No), then the controller 7 increments the value of the parameter n (step S318), and carries out again the process from the step S408. If it is determined that the value of the parameter n is 4 (step S417: Yes), then the controller 7 carries out the process from the step S111 as in the third embodiment.

According to the fourth embodiment, it is possible to lessen the processing load on the controller 7, thereby allowing for suppression of the power consumption of the printer 1 as a whole, compared to the third embodiment.

Further, the abovementioned controller 7 may be either constructed from hardware logics or constructed from software for a CPU (not shown) to carry out predetermined programs.

What is claimed is:

1. A liquid jetting apparatus comprising:

a first head chip having first nozzles arranged in a nozzle arrangement direction;

a second head chip having second nozzles arranged in the nozzle arrangement direction, and being arranged to overlap at least partially with the first head chip in an orthogonal direction orthogonal to the nozzle arrangement direction;

a controller configured to control the first head chip and the second head chip to jet liquid from the first nozzles and the second nozzles; and power sources having different voltages, respectively, wherein each of the first nozzles and the second nozzles is driven by voltage supplied from one of the power sources, the first head chip has a first overlapping portion and the second head chip has a second overlapping portion, the first overlapping portion and the second overlapping portion overlapping in the orthogonal direction with each other, and the controller is configured to:

determine first execution nozzles and second execution nozzles based on print job data;

acquire information of drive voltages for the first execution nozzles, which are included in the first nozzles and from which the liquid is to be jetted, the first execution nozzles including first overlapping nozzles arranged in the first overlapping portion;

acquire information of drive voltages for the first overlapping nozzles;

acquire information of drive voltages for the second execution nozzles, which are included in the second nozzles and from which the liquid is to be jetted, the second execution nozzles including second overlapping nozzles arranged in the second overlapping portion, and wherein the first overlapping nozzles overlap with the second overlapping nozzles respectively in the orthogonal direction;

acquire information of drive voltages for the second overlapping nozzles; and based on the information of the drive voltages for the first execution nozzles, the second execution nozzles, and the number of the first and second execution nozzles driven by the drive voltages for the first overlapping nozzles and the second overlapping nozzles, select one of a first overlapping nozzle and a second overlapping nozzle overlapping in the orthogonal direction with each other to jet the liquid, the first overlapping nozzle being included in the first execution nozzles and included in the first overlapping portion, the second overlapping nozzle being included in the second execution nozzles and included in the second overlapping portion.

2. The liquid jetting apparatus according to claim 1, wherein the first nozzles overlap with the second nozzles in the orthogonal direction, respectively.

3. The liquid jetting apparatus according to claim 2, wherein the entirety of the first head chip and the entirety of the second head chip overlap with each other in the orthogonal direction.

4. The liquid jetting apparatus according to claim 2, wherein the controller is configured to:

compare a drive voltage for the first overlapping nozzle with a drive voltage for the second overlapping nozzle;

based on that the drive voltage for the first overlapping nozzle is smaller than the drive voltage for the second overlapping nozzle, select the first overlapping nozzle; and based on that the drive voltage for the second overlapping nozzle is smaller than the drive voltage for the first overlapping nozzle, select the second overlapping nozzle.

5. The liquid jetting apparatus according to claim 1, wherein the controller is configured to:

calculate a first sum corresponding to the sum of the number of the first execution nozzles driven by the drive voltages for the first overlapping nozzles;

calculate a second sum corresponding to the sum of the number of the second execution nozzles driven by the drive voltages for the second overlapping nozzles;

based on that the first sum is smaller than the second sum, select the first overlapping nozzles; and based on that the second sum is smaller than the first sum, select the second overlapping nozzles.

6. The liquid jetting apparatus according to claim 5, wherein the controller is configured to:

calculate the sum of the number of the first execution nozzles as the first sum, the first execution nozzles being driven by the drive voltages for the first overlapping nozzles and not arranged in the first overlapping portion; and calculate the sum of the number of the second execution nozzles as the second sum, the second execution nozzles being driven by the drive voltages for the second overlapping nozzles and not arranged in the second overlapping portion.

7. The liquid jetting apparatus according to claim 6, wherein based on that the first sum is equal to the second sum, the controller is configured to:

compare a first maximum number with a second maximum number, the first maximum number being the maximum number of the first execution nozzles not arranged in the first overlapping portion, the second maximum number being the maximum number of the second execution nozzles not arranged in the second overlapping portion;

based on that the first maximum number is smaller than the second maximum number, select the first overlapping nozzles; and based on that the second maximum number is smaller than the first maximum number, select the second overlapping nozzles.

8. The liquid jetting apparatus according to claim 1, wherein the controller is configured to:

compare a first maximum number with a second maximum number, the first maximum number being the maximum number of the first execution nozzles, the second maximum number being the maximum number of the second execution nozzles; and based on that the first maximum number is smaller than the second maximum number, select the first overlapping nozzles; and based on that the second maximum number is smaller than the first maximum number, select the second overlapping nozzles.

9. The liquid jetting apparatus according to claim 1, wherein the controller is configured to:

calculate a first average which is an average of the drive voltages for the first execution nozzles;

calculate a second average which is an average of the drive voltages for the second execution nozzles;

based on that the first average is smaller than the second average, select the first overlapping nozzles; and based on that the second average is smaller than the first average, select the second overlapping nozzles.

10. The liquid jetting apparatus according to claim 9, wherein the first nozzles overlap with the second nozzles in the orthogonal direction, respectively.

11. The liquid jetting apparatus according to claim 10, wherein the entirety of the first head chip and the entirety of the second head chip overlap with each other in the orthogonal direction.

12. The liquid jetting apparatus according to claim 10, wherein based on that the first average is equal to the second average, the controller is configured to:

calculate an average of the drive voltages for all of the first nozzles and an average of the drive voltages for all of the second nozzles;

based on that the average of the drive voltages for all of the first nozzles is smaller than the average of the drive voltages for all of the second nozzles, select the first overlapping nozzles; and based on that the average of the drive voltages for all of the second nozzles is smaller than the average of the drive voltages for all of the first nozzles, select the second overlapping nozzles.

13. The liquid jetting apparatus according to claim 9, wherein the controller is configured to:

calculate an average of the drive voltages for the first overlapping nozzles, as the first average; and calculate an average of the drive voltages for the second overlapping nozzles, as the second average.

14. The liquid jetting apparatus according to claim 1, wherein the controller is configured to:

based on a range of a parameter value affecting jetting of the liquid, change each of the drive voltages for the first nozzles and the second nozzles; and based on that the drive voltages have been changed, acquire information of the changed drive voltages for the first overlapping nozzles;

acquire information of the changed drive voltages for the second overlapping nozzles; and based on the information of the changed drive voltages for the first overlapping nozzles and the second overlapping nozzles and the number of the first and second execution nozzles driven by the changed drive voltages for the first overlapping nozzles and the second overlapping nozzles, select one of the first overlapping nozzles and the second overlapping nozzles to jet the liquid.

15. The liquid jetting apparatus according to claim 14, wherein the controller is configured to, based on temperature of the liquid, change each of the drive voltages for the first nozzles and the second nozzles.

16. The liquid jetting apparatus according to claim 14, wherein the controller is configured to, based on the number of jets of each of the first nozzles and the second nozzles, change each of the drive voltages for the first nozzles and the second nozzles.

17. The liquid jetting apparatus according to claim 1, further comprising a sheet conveyer, wherein each of the first head chip and the second chip is positioned to face a sheet conveyed by the sheet conveyer.

18. The liquid jetting apparatus according to claim 1, wherein the controller is configured to:

based on the information of the drive voltages for the first execution nozzles, estimate first heat value of the power sources for driving the first execution nozzles;

based on the information of the drive voltages for the second execution nozzles, estimate second heat value of the power sources for driving the second execution nozzles;

based on the first heat value and the second heat value, select one of the first overlapping nozzle and the second overlapping nozzle.

19. A method for selecting an overlapping nozzle by a controller of a liquid jetting apparatus provided with: a first head chip having first nozzles arranged in a nozzle arrangement direction; a second head chip having second nozzles arranged in the nozzle arrangement direction, and being arranged to overlap at least partially with the first head chip in an orthogonal direction orthogonal to the nozzle arrangement direction; the controller configured to control the first head chip and the second head chip to jet liquid from the first nozzles and the second nozzles; and power sources having different voltages, respectively, wherein each of the first nozzles and the second nozzles is driven by voltage supplied from one of the power sources, and the first head chip has a first overlapping portion and the second head chip has a second overlapping portion, the first overlapping portion and the second overlapping portion overlapping in the orthogonal direction with each other, the method comprising:

acquiring information of drive voltages for first execution nozzles, which are included in the first nozzles and from which the liquid is to be jetted, wherein the first execution nozzles include first overlapping nozzles arranged in the first overlapping portion;

acquiring information of drive voltages for second execution nozzles, which are included in the second nozzles and from which the liquid is to be jetted, wherein the second execution nozzles include second overlapping nozzles arranged in the second overlapping portion, and wherein the first overlapping nozzles overlap with the second overlapping nozzles respectively in the orthogonal direction;

determine the first execution nozzles and the second execution nozzles based on print job data;

acquire information of drive voltages for the first overlapping nozzles, acquire information of drive voltages for the second overlapping nozzles; and based on the information of the drive voltages for the first execution nozzles, the second execution nozzles, and the number of the first and second execution nozzles driven by the drive voltages for the first overlapping nozzles and the second overlapping nozzles, selecting one of a first overlapping nozzle and a second overlapping nozzle overlapping in the orthogonal direction with each other to jet the liquid, the first overlapping nozzle being included in the first execution nozzles and included in the first overlapping portion, the second overlapping nozzle being included in the second execution nozzles and included in the second overlapping portion.

20. The method according to claim 19, further comprising:

based on the information of the drive voltages for the first execution nozzles, estimating first heat value of the power sources for driving the first execution nozzles; and based on the information of the drive voltages for the second execution nozzles, estimating second heat value of the power sources for driving the second execution nozzles, wherein, based on the first heat value and the second heat value, one of the first overlapping nozzle and the second overlapping nozzle is selected.

* * * * *